US012716609B2

(12) United States Patent
Li et al.

(10) Patent No.: US 12,716,609 B2
(45) Date of Patent: Aug. 25, 2026

(54) MULTI-CONNECTED AIR CONDITIONER WITH REFRIGERANT AND WATER SYSTEM

(71) Applicant: TSINGHUA UNIVERSITY, Beijing (CN)

(72) Inventors: Xianting Li, Beijing (CN); Yuan Wang, Beijing (CN); Wentao Wang, Beijing (CN); Chenjiyu Liang, Beijing (CN); Wenxing Shi, Beijing (CN); Baolong Wang, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 278 days.

(21) Appl. No.: 18/572,350

(22) PCT Filed: Jun. 7, 2022

(86) PCT No.: PCT/CN2022/097286
§ 371 (c)(1),
(2) Date: Dec. 20, 2023

(87) PCT Pub. No.: WO2022/267877
PCT Pub. Date: Dec. 29, 2022

(65) Prior Publication Data

US 2024/0288195 A1 Aug. 29, 2024

(30) Foreign Application Priority Data

Jun. 21, 2021 (CN) ..... 202110687908.4

(51) Int. Cl.
*F24F 11/84* (2018.01)
*F24F 5/00* (2006.01)

(52) U.S. Cl.
CPC ..... *F24F 11/84* (2018.01); *F24F 5/001* (2013.01); *F24F 5/0046* (2013.01)

(58) Field of Classification Search
CPC ..... F24F 3/065; F24F 5/0046; F24F 11/84; F24F 5/001; F25B 2313/003;
(Continued)

(56) References Cited

U.S. PATENT DOCUMENTS

2010/0282434 A1 11/2010 Yabuuchi et al.
2020/0386447 A1 12/2020 Wang

FOREIGN PATENT DOCUMENTS

CN 101701737 A 5/2010
CN 101846366 A * 9/2010
(Continued)

OTHER PUBLICATIONS

International Search Report and Written Opinion for International Application No. PCT/CN2022/097286 mailed Aug. 25, 2022.
(Continued)

*Primary Examiner* — Kun Kai Ma
(74) *Attorney, Agent, or Firm* — Ballard Spahr LLP

(57) ABSTRACT

A Multi-connected Air Conditioner with Refrigerant And Water (MACRAW) multi mode system, includes refrigerant circulation loops of multiple air conditioning units, an outdoor heat exchanger and an indoor heat exchanger, a first circulation loop, a second circulation loop and a main heat exchanger. The first circulation loop and the second circulation loop exchange heat through the main heat exchanger, a second medium channel is provided in each of the outdoor heat exchanger and the indoor heat exchanger, the first circulation loop and the second circulation loop, through each second medium channel, exchange heat with a first medium channel and/or a first air heat exchange channel in each outdoor heat exchanger, and with the second medium channel and/or a second air heat exchange channel in indoor heat exchanger.

11 Claims, 17 Drawing Sheets

(58) Field of Classification Search
CPC ..... F25B 2313/004; F25B 2400/06; F25B 13/00; F25B 41/40
See application file for complete search history.

(56) References Cited

FOREIGN PATENT DOCUMENTS

| | | | | | |
|---|---|---|---|---|---|
| CN | 102252385 | A | | 11/2011 | |
| CN | 103017481 | A | | 4/2013 | |
| CN | 202853026 | U | * | 4/2013 | |
| CN | 103322662 | A | | 9/2013 | |
| CN | 104279662 | A | * | 1/2015 | ..... F25B 29/003 |
| CN | 106091480 | A | | 11/2016 | |
| CN | 205847810 | U | * | 12/2016 | |
| CN | 106440590 | A | * | 2/2017 | ..... F24F 5/0089 |
| CN | 207395231 | U | * | 5/2018 | |
| CN | 108302834 | A | | 7/2018 | |
| CN | 109210829 | A | * | 1/2019 | ..... F25B 30/02 |
| CN | 109383228 | A | | 2/2019 | |
| CN | 109764572 | A | | 5/2019 | |
| CN | 110160171 | A | | 8/2019 | |
| CN | 110160178 | A | | 8/2019 | |
| CN | 110160179 | A | | 8/2019 | |
| CN | 209672626 | U | | 11/2019 | |
| CN | 210267538 | U | | 4/2020 | |
| CN | 111442446 | A | | 7/2020 | |
| CN | 111998581 | A | * | 11/2020 | ..... F24D 15/04 |
| CN | 112178835 | A | | 1/2021 | |
| CN | 212362532 | U | * | 1/2021 | |
| CN | 112413750 | A | | 2/2021 | |
| CN | 113483412 | A | * | 10/2021 | ..... F24F 5/0046 |
| EP | 2217862 | A2 | | 8/2010 | |
| JP | H0849939 | A | * | 2/1996 | ..... F25B 13/00 |
| JP | 2001255035 | A | | 9/2001 | |
| JP | 2018112356 | A | | 7/2018 | |
| JP | 2021012016 | A | * | 2/2021 | |
| WO | WO-2011089637 | A1 | * | 7/2011 | ..... F24F 3/065 |
| WO | 2020235786 | A1 | | 11/2020 | |

OTHER PUBLICATIONS

Li , et al., "Simulation of Recombined Household Multi-Split Variable Refrigerant Flow System with Split-Type Air Conditioners", Applied Thermal Engineering vol. 117. http://dx.doi.org/10.1016/j.applthermaleng.2017.02.003, Feb. 5, 2017, pp. 343-354.

Xanting , et al., "New Central Air Conditioning System Based on Low-Grade Energy-Bus", HV&AC, Apr. 2, 2011, pp. 1-8.

European Search Report for European Application No. 22827373.6 mailed Aug. 30, 2024.

Office Action for Japanese Application No. 2023-579040 mailed Dec. 24, 2024.

Office Action for Japanese Application No. 2023-579040 mailed May 13, 2025.

Office Action for Japanese Application No. 2023-579040 mailed Dec. 2, 2025.

* cited by examiner (1) air conditioning unit C.6

(2) air conditioning unit C.7

(3) air conditioning unit C.k

MULTI-CONNECTED AIR CONDITIONER WITH REFRIGERANT AND WATER SYSTEM

CROSS-REFERENCE TO RELATED APPLICATION

The present application is a U.S. National Stage of International Application No. PCT/CN2022/097286, filed on Jun. 7, 2022, which claims priority to Chinese patent application No. 202110687908.4 filed on Jun. 21, 2021, entitled "Multi-connected Air Conditioner with Refrigerant And Water (MACRAW) System" which are hereby incorporated by reference in their entireties.

TECHNICAL FIELD

The present application relates to the field of air conditioning, and in particular, to a multi-mode MACRAW system.

BACKGROUND

Energy expenditure and greenhouse gas emissions associated with the operation of buildings account for about one-third of the total amount. The energy consumption of heating, ventilation, air conditioning, and domestic hot water accounts for more than two-thirds, which is the main part of building energy consumption. Furthermore, with the enhancement of building functions and the demand for comfort, the proportion of energy consumption is increasing year by year. Therefore, improving the energy efficiency of air conditioning systems is an important way to reduce total societal energy consumption, conserve energy and reduce emissions.

Air conditioning systems are mainly divided into two categories: centralized air conditioning systems and decentralized air conditioning systems. The commonly applied decentralized air conditioning systems mainly include a combined system of chiller units and fan coil units, as well as variable refrigerant flow (VRF) air conditioning systems. The combined system connects each terminal to a host through a circulating water system to provide long-distance energy transmission. However, in this solution, a heat exchange link between the refrigerant and the water is added, which restricts the operating efficiency of the system. On the other hand, a direct expansion scheme is adopted in the VRF systems to improve the efficiency of the unit through direct heat exchange between the refrigerant and the air. The performance of the VRF system is significantly affected by the length of the piping and the height difference, which limits long-distance energy transport and the capability to utilize the advantages of water systems-such as using natural energy or municipal water for free cooling and heating. Furthermore, in public buildings, it is typical for some rooms to require cooling while other rooms need heating simultaneously. The main heat recovery schemes currently available are heat recovery VRF systems and water loop heat pumps. The heat recovery VRF systems are constrained by the size of the system and tends to be less efficient under low load conditions while the water loop heat pumps often have problems with the mixing of cold and hot water within the loop.

To solve the above problems, a multi-mode water loop multi-connected air conditioning system has been disclosed in the Chinese utility model patent with the application number 20/1920627088.8. This system chooses a three-fluid heat exchanger, which can directly exchange heat between any two of the three fluids (water, refrigerant, air), as the indoor and outdoor heat exchangers of the VRF system. By connecting the water loops of the three-fluid heat exchangers to form a water loop, this system combines the advantages of the water system and the refrigerant system, and can provide cooling and heating in multiple modes. For example, the outdoor heat exchanger is air-cooled or water-cooled modes; some indoor heat exchangers are cooled, and other indoor heat exchangers are heated at the same time; free cooling and heating are provided using natural energy; when the load is low, some outdoor heat exchangers simultaneously produce cold and hot air and cold and hot water, supplying all indoor heat exchangers; and it assures uninterrupted heating during defrost cycles.

However, there are some constraints and deficiencies in the application of this system.

1. The system cannot accommodate the high-efficiency and energy-saving operating conditions that frequently occur in actual operation. As a result, in most cases, there are no significant energy-saving or functional achievements compared with traditional air conditioning systems. The following commonly efficient operating conditions cannot be realized.

(1) Some rooms, such as those in the inner area, may require cooling at certain times and heating at others. During such time, the outdoor unit mainly uses air-cooled heating and typically needs defrosting. Consequently, the system is unable to support an operational mode where "low load ratio cooling occurs simultaneously with heating for defrosting in part of the unit".

(2) Although a single water loop can be switched into two loops, the outdoor heat exchanger is a water source, at this time there can only be one water temperature inside, if cooling is realized, it cannot provide heating for other non-operating units; if heating is realized, it cannot provide cooling for the room. That is, the "low load rate cooling while low load rate heating" operation mode cannot be realized.

(3) During the transition season, the typical scenario is that the water (or ground) source can be used directly for cooling in the inner area. However, the issue of low load rate heating cannot be solved at this time. That is, the "natural energy free cooling while low load rate heating" operation mode cannot be realized.

(4) Referring to (3), the "low load rate heating while recovering evaporator cold for free cooling" mode cannot be realized.

2. All indoor heat exchangers of this system are connected in parallel on the same water loop, and it is impossible to flexibly switch any indoor heat exchanger cooling and heating conditions when cooling and heating are needed at the same time.

3. By connecting all indoor and outdoor heat exchangers through a single water loop, when the indoor heat exchanger loop and the outdoor heat exchanger loop require different parameters, the following defects will occur:

(1) Although the system can divide the total water loop into the outdoor heat exchanger water loop and the indoor heat exchanger water loop through the opening and closing of the valve, the outdoor and indoor heat exchanger water loops cannot directly exchange heat to fully utilize the energy of the outdoor heat exchanger water loop, that is, natural energy is only connected to the outdoor heat exchanger side loop and cannot be directly used for the indoor heat exchanger side.

(2) Since natural energy is only connected to the outdoor side of this system, it cannot meet the situation where both indoor and outdoor loops need to use natural energy at the same time, that is, if multiple composite operation modes need to be realized, this system cannot be implemented and executed, which restricts the practicality and flexibility of actual applications.

4. When the single water loop is switched to two water loops for operation, two constant pressure points are needed, and only one constant pressure point is needed when merged into one water loop. The constant pressure point needs to be set and switched, which results in the unstable pressure in the system. In addition, the outdoor heat exchanger loop and the indoor heat exchanger loop of this system cannot use two types of refrigerating medium, for example, the outdoor heat exchanger loop uses antifreeze, and the indoor heat exchanger loop uses water, to take into account the advantages of antifreeze and heat exchange of the two refrigerating media.

5. This system only adopts a terminal in the form of air. The thermal comfort inside is poor when heating in winter, and it can no longer meet the increasing requirements of people for room comfort.

Therefore, although the system in the prior art can provide refrigeration and heating schemes under various modes throughout the year, it is not the most suitable, energy-saving and reliable system under most energy demands.

SUMMARY

The present application provides a multi-mode MACRAW system, which can have multiple operation modes. Through various operation modes, it can not only have the functions of the prior art, but also efficiently utilize natural energy and recover heat. Furthermore, the system allows for defrosting, free scheduling of cooling and heating across various systems, and improved operating efficiency at low load rates. It ensures stable and efficient operation of the air conditioning system throughout the entire year.

The multi-mode MACRAW system includes multiple air conditioning units, each of the multiple air conditioning unit includes a refrigerant circulation loop, at least one outdoor heat exchanger and at least one indoor heat exchanger. Refrigerant circulation loops within the multiple air conditioning units are independent of each other. A first medium channel is provided inside the outdoor heat exchanger and the indoor heat exchanger, respectively. The outdoor heat exchanger and the indoor heat exchanger in each air conditioning unit communicate with each independent refrigerant circulation loop through the first medium channel. The communication, closure and flow regulation of the first medium channel in each indoor heat exchanger are controlled by disposing an expansion valve. The refrigerant circulation loop is provided with a compressor for driving the refrigerant to flow and a four-way valve for switching a flow direction of the refrigerant. The multi-mode MACRAW system further includes a first circulation loop, a second circulation loop and a main heat exchanger. The first circulation loop is provided with a first circulation pump and a natural energy collector, and the second circulation loop is provided with a second circulation pump. The first circulation loop and the second circulation loop exchange heat with each other through the main heat exchanger. A second medium channel is provided inside the outdoor heat exchanger and the indoor heat exchanger. The outdoor heat exchanger of each air conditioning unit is connected in parallel and communicates with the first circulation loop through the second medium channel, the first circulation loop can exchange heat with the first medium channel in each outdoor heat exchanger through each second medium channel. A first air heat exchange channel is also provided inside each outdoor heat exchanger. The first air heat exchange channel exchanges heat with the first medium channel and/or the second medium channel within the outdoor heat exchanger, and the heat in the first air heat exchange channel is driven to the outside with the airflow by disposing a fan. The indoor heat exchangers of each air conditioning unit are connected in parallel and communicate with the second circulation loop through the second medium channel, the second circulation loop can exchange heat with the first medium channel in each indoor heat exchanger through each second medium channel. The communication and closure between the second medium channel in each outdoor heat exchanger and the first circulation loop are controlled by disposing a valve, and the communication and closure between the second medium channel in each indoor heat exchanger and the second circulation loop are controlled by disposing a valve. A second air heat exchange channel is further provided inside each indoor heat exchanger. The second air heat exchange channel exchanges heat with the first medium channel and/or the second medium channel within the indoor heat exchanger, and the heat in the second air heat exchange channel is driven to a room with the airflow by disposing a fan.

The multi-mode MACRAW system according to the present application further includes a third circulation loop. The third circulation loop is provided with a third circulation pump. The indoor heat exchanger of each air conditioning unit is separately connected in parallel and communicates with the third circulation loop through the second medium channel. This allows the third circulation loop to exchange heat with the first medium channel and/or the second air heat exchange channel in each indoor heat exchanger via each second medium channel. The third circulation loop is separated from the second circulation loop by disposing a valve, and the communication and closure between the third circulation loop and each second medium channel are controlled by the valve.

The multi-mode MACRAW system according to the present application further includes at least one heat exchange device. The heat exchange device is separately connected in parallel and communicates with the second circulation loop and/or the third circulation loop. The communication and closure between the heat exchange device and the second circulation loop, and between the heat exchange device and the third circulation loop are controlled by disposing valves.

In the multi-mode MACRAW system according to the present application, the first circulation loop is provided with a first bypass, which is connected in parallel and communicates with both ends of the natural energy collector. The communication and closure of the first bypasses and the natural energy collector are controlled by disposing a valve.

In the multi-mode MACRAW system according to the present application, a second bypass is connected in parallel and communicates with the first circulation loop, and a third bypass is connected in parallel and communicate with the second circulation loop. The second and third bypasses are separately connected in parallel and communicate with both ends of the main heat exchanger. The communication and closure of the second bypass, the third bypass, and the main heat exchanger are controlled by disposing valves.

In the multi-mode MACRAW system according to the present application, the second circulation loop communicates with the natural energy collector through a bypass. The natural energy collector communicates between the second circulation pump and the main heat exchanger through a bypass.

In the multi-mode MACRAW system according to the present application, each of the heat exchange devices is at least one of the following: a ceiling heat radiator, a wall heat radiator, a floor heat radiator, or a liquid storage heater.

In the multi-mode MACRAW system according to the present application, the air conditioning unit is a multi-connected air conditioning unit with heat recovery function, so that the air conditioning unit can recover the heat and transfer the cold and heat between multiple indoor heat exchangers through refrigerant pipelines inside the air conditioning unit.

In the multi-mode MACRAW system according to the present application, the natural energy collector is at least one of the following: a geothermal energy collection device, an underground hot water thermal energy collection device, a solar thermal collector, an indirect evaporative cooling unit, a cooling tower, a building waste heat collection device or an industrial waste heat collection device.

In the multi-mode MACRAW system according to the present application, each air conditioning unit further includes a throttling device, an oil separator, a gas-liquid separator, a sub-cooler, and a throttling device. The refrigerant circulation loop of the air conditioning unit is jointly constituted by the outdoor heat exchanger, the compressor, the four-way valve, the throttling device, the indoor heat exchangers, the oil separator, the gas-liquid separator, and the sub-cooler.

In the multi-mode MACRAW system according to the present application, the circulating medium in the first, second, and third circulation loops is water or antifreeze.

In the multi-mode MACRAW system according to the present application, when a refrigerating medium used in the first circulation loop is the same as a refrigerating medium used in the second or third circulation loop, the main heat exchanger serves as a passage communicating the first circulation loop with the second circulation loop or the third circulation loop, so that one of the second circulation loop and the third circulation loop is merged with the first circulation loop to form a fourth circulation loop. Another of the second circulation loop and the third circulation loop is merged with the first circulation loop to form a fifth circulation loop and the outdoor heat exchanger is connected in parallel therein.

The multi-mode MACRAW system according to the present application, compared with the prior art, has the following characteristics and effects.

(1) The system, on the basis of connecting all outdoor heat exchangers in parallel in one loop, connects all indoor heat exchangers in parallel in two other independent loops simultaneously. The inlet and outlet of all indoor heat exchangers are switchable and connected freely on the two loops, and thus different operating parameters are provided for the two loops. The indoor heat exchangers can be divided into different independent loops according to the functions of different rooms.

(2) The loop where the outdoor heat exchangers are located and the loop where the indoor heat exchangers are located are respectively provided with two sets of independent loops, and thermal operating conditions of both are connected through the heat exchanger.

(3) Both loops can be connected to natural energy or other energy recovery equipment, and natural energy or recovered energy is more flexibly used to further improve system energy efficiency.

(4) The system can provide two different operating parameters, freely schedule of the cooling and heating load of each system, avoid energy grade losses due to mixing, and can use different types of refrigerating medium, and take into account the advantages of antifreeze and heat exchange.

(5) The system according to the present application can have multiple operation modes. Through various operation modes, in addition to having all functions of a multi-mode water loop multi-connected air-conditioning system disclosed in Chinese Utility Model Patent with application number 20/1920627088.8, it can also facilitate matching different parameters of natural energy and different terminal energy needs, further improve the system efficiency under partial load or even minimal load, avoid simultaneous cooling, simultaneous heating and other conditions, and energy mixing caused by different system requirements, not limited by the operating parameters of the refrigerant loop and water loop, can realize the indoor heat exchanger freely switching cooling or heating mode.

(6) It can balance the need for quick response of intermittent heating and thermal comfort.

(7) The system can efficiently utilize natural energy, recover energy, freely schedule cooling and heating load between systems, defrost by freely scheduling heat, and can improve operating efficiency under low load rate, which ensures that the air conditioning system can operate stably and efficiently throughout the year.

BRIEF DESCRIPTION OF DRAWINGS

To describe the technical solutions in the present application or in the prior art more clearly, the following briefly describes the accompanying drawings used in describing embodiments or the prior art. It is clear that the accompanying drawings in the following descriptions show some embodiments of the present application, and a person skilled in the art may still derive other drawings from these accompanying drawings without creative efforts.

DETAILED DESCRIPTION OF THE EMBODIMENTS

To make the objectives, technical solutions, and advantages of the present application clearer, the following clearly and completely describes the technical solutions in the present application with reference to the accompanying drawings in the present application. The described embodiments are merely some but not all embodiments of the present application. Based on embodiments of the present application, all other embodiments obtained by a person skilled in the art without creative effort fall within the scope of protection of the present application.

Figure 1:
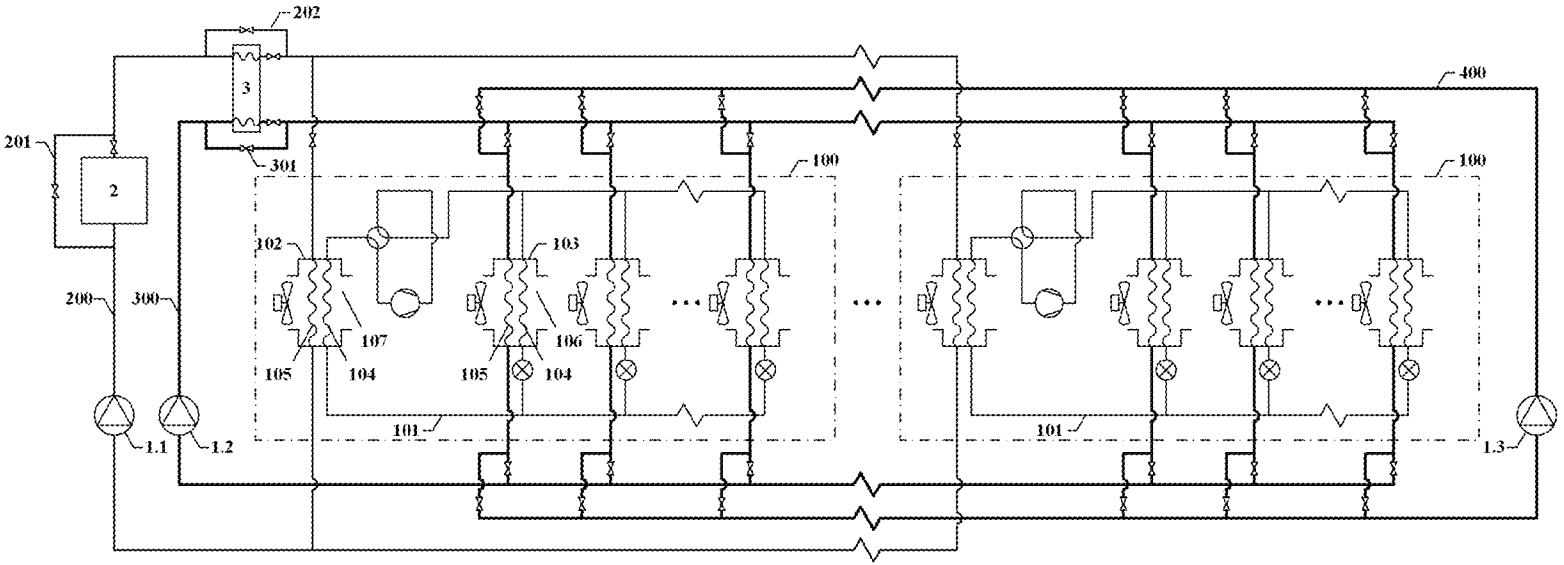
FIG. 1 is a schematic diagram of a structure principle according to the present application.

The following describes a multi-mode multi-connected air conditioner with refrigerant and water (MACRAW) system according to the present application with reference to FIG. 1. As shown in FIG. 1, the system includes multiple air conditioning units 100. Each air conditioning unit 100 includes a refrigerant circulation loop 101, an outdoor heat exchanger 102 and multiple indoor heat exchangers 103. The refrigerant circulation loops 101 within each air conditioning unit 100 are independent of each other. A first medium channel 104 is provided inside the outdoor heat exchanger 102 and indoor heat exchanger 103, respectively, and the outdoor heat exchanger 102 and indoor heat exchanger 103 within each air conditioning unit 100 communicate with the independent refrigerant circulation loop 101 through the first medium channel 104. In addition, in order to independently control the first medium channel 104 in each indoor heat exchanger 103, the conduction, closure, and flow adjustment of the first medium channel 104 in each indoor heat exchanger 103 is controlled by disposing an expansion valve in the system pipeline.

At the same time, a first air heat exchange channel 107 is formed in each outdoor heat exchanger 102. The first air heat exchange channel 107 exchanges heat with the first medium channel 104 and/or the second medium channel 105 in the outdoor heat exchanger 102, and drives the heat in the first air heat exchange channel 107 to be transferred to the outside with the air flow by installing a fan (not shown in the figure). Similarly, a second air heat exchange channel 106 is formed in each indoor heat exchanger 103. The second air heat exchange channel 106 exchanges heat with the first medium channel 104 and/or the second medium channel 105 in the indoor heat exchanger 103, and drives the heat in the second air heat exchange channel 106 to be diffused into the room with the airflow by installing a fan (not labeled in the figure). That is, the second air heat exchange channel 106 absorbs heat from the first medium channel 104 and/or the second medium channel 105, and then drives the air flow in the second air heat exchange channel 106 to flow by the fan, so that the heat in the second air heat exchange channel 106 can be transferred with the airflow, thus transferring the heat of the indoor heat exchanger 103 to each room for cooling or heating. In practical applications, the indoor heat exchanger 103 is a three-medium heat exchanger with three medium channels.

The refrigerant circulation loop 101 is provided with a compressor for driving the refrigerant to flow and a four-way valve for switching a flow direction of the refrigerant. In practical applications, each air conditioning unit 100 further includes a throttling device, an oil separator, a gas-liquid separator, and a sub-cooler. The refrigerant circulation loop of the air conditioning unit is jointly constituted by the outdoor heat exchanger, the compressor, the four-way valve, the throttling device, the indoor heat exchangers, the oil separator, the gas-liquid separator, and the sub-cooler.

In addition to the above, the system further includes a first circulation loop 200, a second circulation loop 300, and a main heat exchanger 3. The first circulation loop 200 is provided with a first circulation pump 1.1 and a natural energy collector 2. The second circulation loop 300 is provided with a second circulation pump 1.2. The first and second circulation loops 200 and 300 exchange heat with each other through the main heat exchanger 3. A second medium channel 105 is provided inside the outdoor heat exchanger 102 and indoor heat exchanger 103, respectively. The outdoor heat exchangers 102 of each air conditioning unit 100 are respectively connected in parallel and communicate with the first circulation loop 200 through the second medium channels 105 provided inside the outdoor heat exchangers 102, so that the first circulation loop 200 can exchange heat with the first medium channel 104 in each outdoor heat exchanger 102 through each second medium channel 105. Furthermore, the indoor heat exchangers 103 of each air conditioning unit 100 are respectively connected in parallel and communicate with the second circulation loop 300 through second medium channels 105, and the second circulation loop 300 can exchange heat with the first medium channel 104 within each indoor heat exchanger 103 through each second medium channel 105.

In order to independently control each second medium channel 105, multiple valves are disposed in pipelines of the system to control the communication and closure between the second medium channels 105 within each outdoor heat exchanger 102 and the first circulation loop 200. Similarly, valves are disposed to control the communication and closure between the second medium channels 105 within each indoor heat exchanger 103 and the second circulation loop 300.

Furthermore, the system further includes a third circulation loop 400 provided with a third circulation pump 1.3. The indoor heat exchangers 103 of each air conditioning unit 100 are respectively connected in parallel and communicate with the third circulation loop 400 through the second medium channels 105 provided inside the indoor heat exchangers 103, so that the third circulation loop 400 can exchange heat with the first medium channel 104 in each indoor heat exchanger 103 through each second medium channel 105, and can also exchange heat with the second air heat exchange channel 106 in each indoor heat exchanger 103. In addition, in order to independently control the second circulation loop 300 and the third circulation loop 400, the third circulation loop 400 is separated from the second circulation loop 300 by multiple valves, and the communication and closure between the third circulation loop 400 and each second medium channel 105 are controlled by valves.

Specifically, the second circulation loop 300 and the third circulation loop 400 are each connected to both ends of the second medium channel 105 via multiple branches. By disposing valves on all branches, the second circulation loop 300 and the third circulation loop 400 can be independently switched and controlled.

The circulating medium in the first circulation loop 200, the second circulation loop 300, and the third circulation loop 400 is a refrigerating medium such as water or antifreeze, etc.

It should be noted that the circulating medium used in the first circulation loop 200, the second circulation loop 300, and the third circulation loop 400 can be the same or different. For example, when the circulating medium used in the first circulation loop 200, the second circulation loop 300, and the third circulation loop 400 is the same (for example, all are antifreeze), one of the second circulation loop 300 and the third circulation loop 400 can be merged with the first circulation loop 200. The merged circulation loop is the fourth circulation loop 500, and the outdoor heat exchanger 102 is connected in paralleled with the other one of the second circulation loop 300 and the third circulation loop 400 to form the fifth circulation loop 600. At this time, the fourth circulation loop 500 integrates the functions of one of the second circulation loop 300 and the third circulation loop 400 with the first circulation loop 200, and the structure of the system is simpler.

In this embodiment, on the one hand, the circulating medium in all circulation loops is the same, which is convenient for unified configuration and standardized manufacturing and maintenance; on the other hand, when the circulating medium in each circulation loop is the same, the main heat exchanger 3 does not need to use complex piping operations, but can be directly designed as a path connecting two circulation loops, so that the system can provide the same function based on the fourth circulation loop 500 and the fifth circulation loop 600. Compared with the original structure of the three circulation loops, the structure is simpler since one circulation pump can be decreased, and the heat exchange efficiency of the path-type main heat exchanger 3 is higher. Specifically, the path-type main heat exchanger 3 only needs to consider the heat loss during circulation in the path.

The above embodiment is just one of many embodiments of the present application. In actual use, it can be decided to adopt whether the structure of three circulation loops or the structure of two circulation loops according to user needs.

Additionally, the first circulation loop 200 is provided with a first bypass 201, and the first bypass 201 is connected in parallel and communicate with both ends of the natural energy collector 2. The communication and closure of the first bypass 201 and the natural energy collector 2 can be controlled by disposing valves. A second bypass 202 is connected in parallel and communicate with the first circulation loop 200, and a third bypass 301 is connected in parallel and communicate with the second circulation loop 300. The second bypass 202 and the third bypass 301 are connected in parallel and communicate with both ends of the main heat exchanger 3, and the communication and closure of the second bypass 202, the third bypass 301, and the main heat exchanger 3 can be controlled by disposing valves.

In an embodiment, the second circulation loop 300 communicates with a natural energy collector (not shown in the figure) through a bypass. The natural energy collector communicates between the second circulation pump 1.2 and the main heat exchanger 3 through a bypass.

In an embodiment, the natural energy collector is at least one of a geothermal energy collection device, an underground hot water heat collection device, a solar heat collection device, an indirect evaporative cooling device, a cooling tower, a building waste heat collection device, or an industrial waste heat collection device.

In an embodiment, the air conditioning unit 100 of the present embodiment is a multi-connected air conditioning unit with a heat recovery function, so that the air conditioning unit 100 can provide heat recovery function and transfer cold and heat energy among multiple indoor heat exchangers through the internal refrigerant pipeline.

In an embodiment, when the refrigerating media used in the first circulation loop 200 and the second circulation loop 300 or the third circulation loop 400 of this embodiment are the same, the main heat exchanger 3 can serve as a passage to merge the first circulation loop 200 and the second circulation loop 300 or the third circulation loop 400 into one loop.

Figure 2:
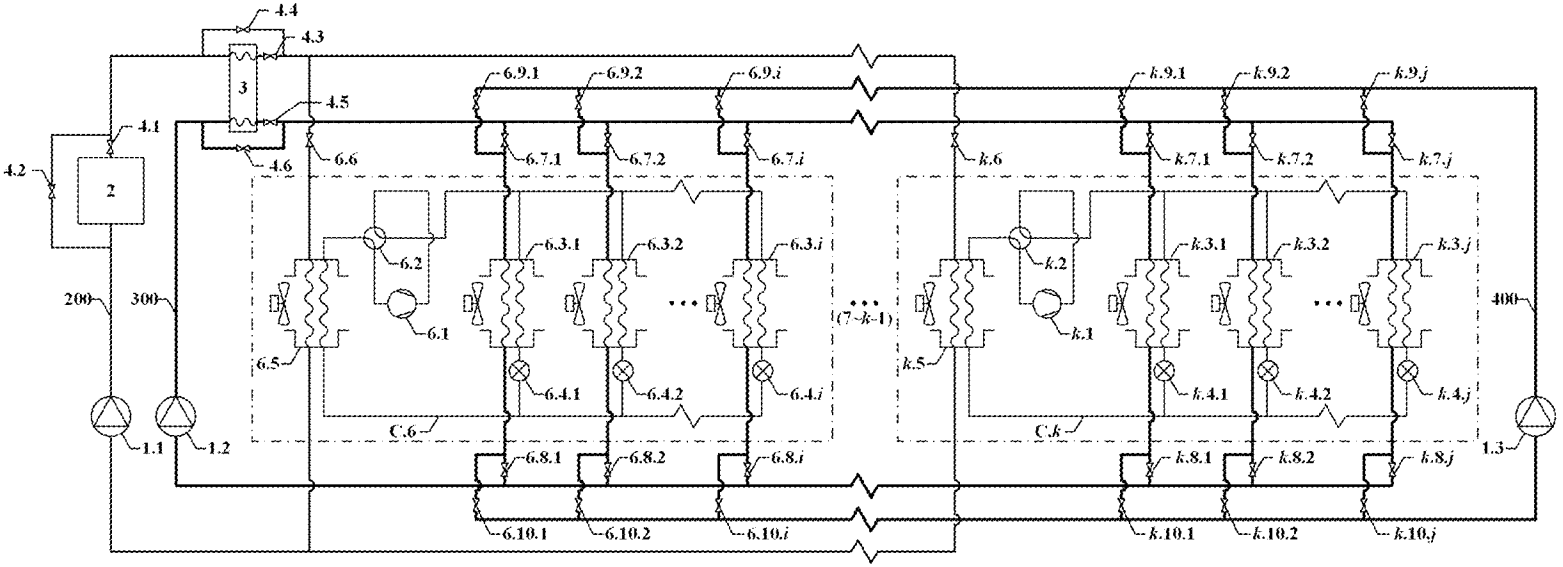
FIG. 2 is a schematic diagram of an embodiment according to the present application.

Based on the system of the present application, various operation modes can be realized. Through these operation modes, the system not only can have the functions of the prior art, but also efficiently utilize natural energy, recover heat, defrost, freely schedule cold and heat between systems, and enhance operating efficiency under low load rate, which ensures that the air conditioning system can operate stably and efficiently throughout the year. The various operation modes are specifically explained below in conjunction with system operation mode FIG. 2 to FIG. 15 and FIG. 16:

In conjunction with FIG. 2, FIG. 16 and FIG. 17, in the system operation mode diagrams below, two air conditioning units 100 are shown in FIG. 2, one of which is C.6 and the last one is C.k. In this embodiment, it is assumed that there are two air conditioning units 100 in the system, each having an outdoor heat exchanger 102 and three indoor heat exchangers 103. The outdoor heat exchanger 102 includes air conditioning outdoor units 6.5 and 7.5, and the indoor heat exchangers 103 include air conditioning indoor units 6.3.1, 6.3.2, 6.3.3, 7.3.1, 7.3.2, and 7.3.3. The first medium channels 104 in air conditioning outdoor units 6.5 and 7.5 are refrigerant pipelines 6.5.2 and 7.5.2, and the second medium channels 105 are refrigerating medium pipelines 6.5.1 and 7.5.1. The first medium channels 104 in air conditioning indoor units 6.3.1, 6.3.2, 6.3.3, 7.3.1, 7.3.2, 7.3.3 are refrigerant pipelines 6.3.1.2, 6.3.2.2, 6.3.3.2, 7.3.1.2, 7.3.2.2, 7.3.3.2, respectively, and the second medium channels 105 are refrigerating medium pipelines 6.3.1.1, 6.3.2.1, 6.3.3.1, 7.3.1.1, 7.3.2.1, 7.3.3.1, respectively. The other valves are described as follows.

(1) The Process of the Air Source Operation Mode is Described as Follows.

Figure 3:
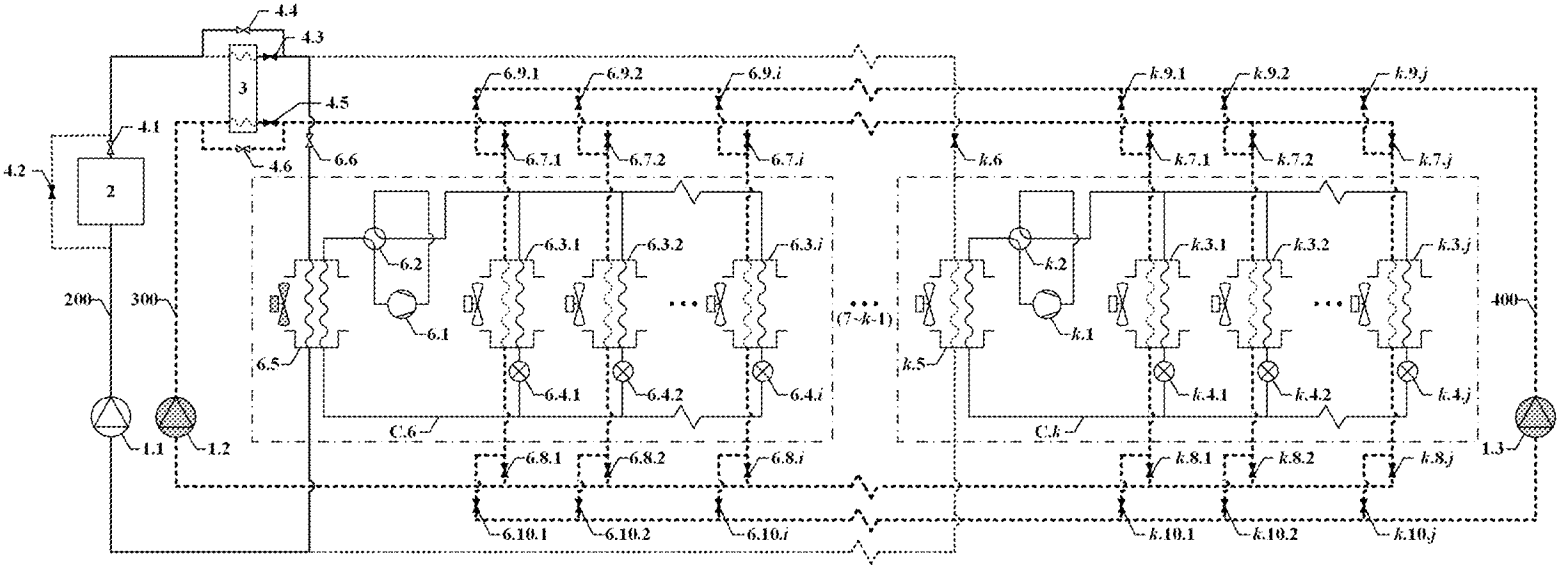
FIG. 3 is a working principle and a schematic structural diagram of the partial water-cooling and simultaneous air-cooling operation mode of the outdoor units in the system of the present application.

As shown in FIG. 3, the compressors 6.1 and 7.1 are started to operate the refrigerant circulation loop 101, and expansion valves 6.4.1, 6.4.2, 6.4.3, 7.4.1, 7.4.2, 7.4.3 are opened, fans 6.5.3 and 7.5.3 on the outdoor units are started, and other valves are closed. At this time, the refrigerant pipelines 6.5.2 and 7.5.2 of the outdoor units can exchange heat with the outside air through the first air heat exchange channel 107 of the outdoor units, thereby realizing the air source operation mode.

(2) The Process of the Water Source Operation Mode is Described as Follows.

As shown in FIG. 3, compressors 6.1 and 7.1 are started to operate the refrigerant circulation loop 101, and expansion valves 6.4.1, 6.4.2, 6.4.3, 7.4.1, 7.4.2, 7.4.3 are opened, valves 6.6, 7.6, 4.1, 4.4 are opened, and other valves are closed. The first circulation pump 1.1 is started to operate the first circulation loop 200, and the natural energy collector 2 is started. The fans 6.5.3 and 7.5.3 on each air conditioning outdoor unit are shut. At this time, the refrigerant pipeline 6.5.2 can exchange heat with the refrigerating medium pipeline 6.5.1, and the refrigerant pipeline 7.5.2 can exchange heat with the refrigerating medium pipeline 7.5.1, and the water source operation mode is provided.

(3) The Process of a Combined Operation Mode of Air Source and Water Source is Described as Follows.

As shown in FIG. 3, the compressors 6.1 and 7.1 are started to operate the refrigerant circulation loop 101. The expansion valves 6.4.1, 6.4.2, 6.4.3, 7.4.1, 7.4.2, and 7.4.3 are opened, and the valves 6.6, 4.1, and 4.4 are opened, while other valves are closed. The refrigerating medium in the first circulation loop 200 passes only through the refrigerating medium pipeline 6.5.1 inside the air conditioning outdoor unit 6.5. Furthermore, the fan 6.5.3 on the air conditioning outdoor unit 6.5 is shut, while the fan 7.5.3 on the air conditioning outdoor unit 7.5 is started. At this time, the refrigerant pipeline 6.5.2 of the air conditioning outdoor unit 6.5 can exchange heat with the refrigerating medium pipeline 6.5.1 to achieve the water source operation mode. In addition, under the action of the fan 7.5.3, the refrigerant pipeline 7.5.2 can exchange heat with the outside air through the first air heat exchange channel 107 to achieve the air source operation mode. Therefore, the entire system can achieve a combined operation mode of air source and water source.

(4) The Process of Simultaneous Cooling and Heating Operation Modes is Described as Follows.

Figure 4:
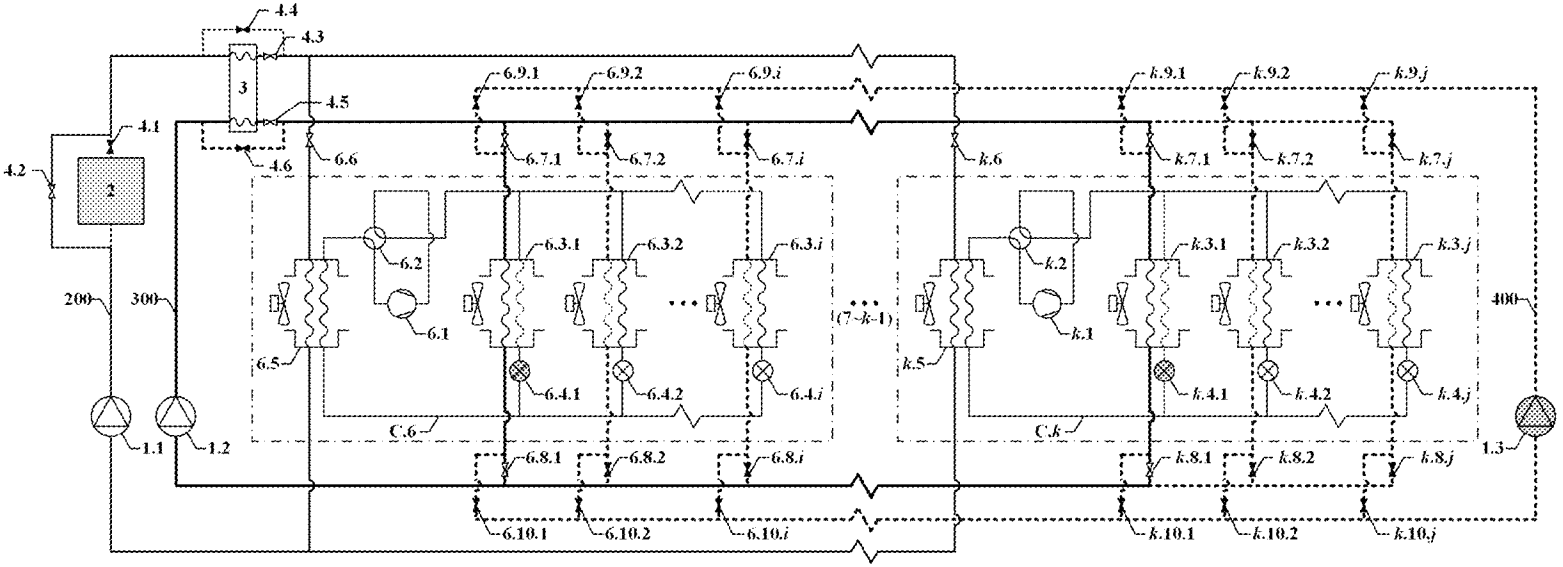
FIG. 4 is a schematic diagram of the simultaneous cooling and heating operation mode implemented by the system of the present application.

As shown in FIG. 4, when different rooms have simultaneous cooling and heating demands, and it is assumed that the air conditioning indoor units 6.3.2, 6.3.3, 7.3.2, 7.3.3 have heating demand, and indoor units 6.3.1, 7.3.1 have cooling demand. At this time, expansion valves 6.4.2, 6.4.3, 7.4.2, 7.4.3 are opened, expansion valves 6.4.1, 7.4.1 are closed, valves 4.2, 4.3, 4.5, 6.6, 7.6, 6.7.1, 6.8.1, 7.7.1, 7.8.1 are opened, other valves are closed, the first circulation pump 1.1 and the second circulation pump 1.2 are started to operate both the first circulation loop 200 and the second circulation loop 300, the third circulation pump 1.3 is shut, compressors 6.1, 7.1 are started, and four-way valves 6.2, 7.2 are adjusted to operate in heating mode. The air conditioning indoor units 6.3.2, 6.3.3, 7.3.2, 7.3.3 serve as condensers, and the outdoor units 6.5, 7.5 serve as evaporators. The air conditioning indoor units 6.3.2, 6.3.3, 7.3.2, 7.3.3, serving as condensers, transfer the heat in their refrigerant pipelines 6.3.2.2, 6.3.3.2, 7.3.2.2, 7.3.3.2 to the air in the second air heat exchange channel 106 under the action of fans 6.3.2.3, 6.3.3.3, 7.3.2.3, 7.3.3.3, hot air is formed to provide the heating needs of the indoor rooms, and the heat pump heating mode is provided. The air conditioning outdoor units 6.5, 7.5, serving as evaporators, can transfer the evaporative cold to the refrigerating medium pipelines 6.5.1 and 7.5.1 through heat exchange between the refrigerant pipeline 6.5.2 and the refrigerating medium pipeline 6.5.1 and between the refrigerant pipeline 7.5.2 and the refrigerating medium pipeline 7.5.1. Under the circulation action of the first circulation pump 1.1, the evaporative cold passes through the refrigerating medium pipeline 6.5.1, the refrigerating medium pipeline 7.5.1, the first circulation pump 1.1, the valve 4.2, and the main heat exchanger 3, the valve 4.3, the valve 6.6, the valve 7.6, the refrigerating medium pipeline 6.5.1, and the refrigerating medium pipeline 7.5.1 to form a circulation loop, that is, the evaporative cold is collected from various evaporators through the first circulation loop 200 and then transferred to the second circulation loop 300 at the main heat exchanger 3. Under the circulation action of the second circulation pump 1.2, the evaporative cold obtained by the second circulation loop 300 at the main heat exchanger 3 passes through the main heat exchanger 3, valves 4.5, 6.7.1, 7.7.1, refrigerating medium pipelines 6.3.1.1, 7.3.1.1, valves 6.8.1, 7.8.1, the second circulation pump 1.2, and the main heat exchanger 3 to form a circulation loop. When the evaporative cold passes through refrigerating medium pipelines 6.3.1.1, 7.3.1.1, it is transferred to the air in the second air heat exchange channel 106 under the action of fans 6.3.1.3, 7.3.1.3, cool air is formed to meet the cooling needs of the indoor rooms, achieving free cooling mode. Therefore, the entire system can achieve simultaneous cooling and heating modes. Similarly, when indoor units 6.3.2, 6.3.3, 7.3.2, 7.3.3 have cooling needs, and indoor units 7.3.2, 7.3.3 have heating needs, a free heating mode can be implemented.

(5) The Process of Free Cooling/Heating Operation Mode is Described as Follows.

Figure 5:
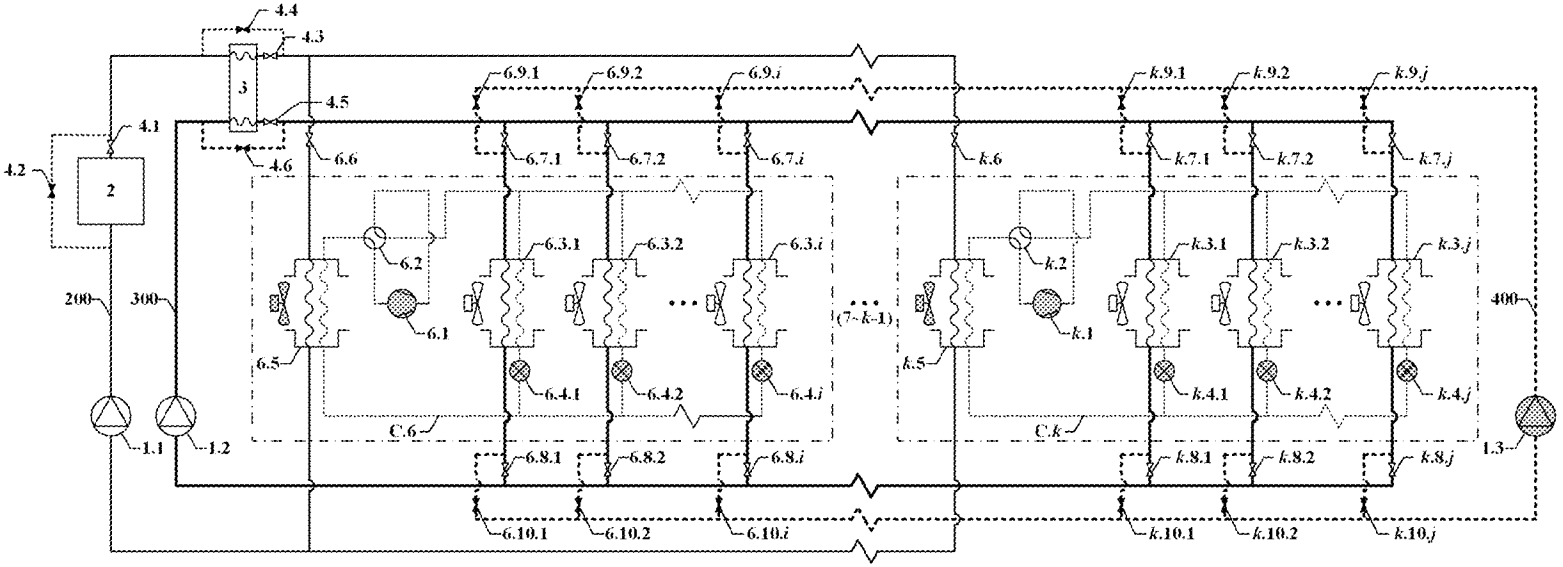
FIG. 5 is a schematic diagram of the Free cooling/Free heating operation mode implemented by the system of the present application.

As shown in FIG. 5, when the parameters of the external natural energy are suitable, expansion valves 6.4.1, 6.4.2, 6.4.3, 7.4.1, 7.4.2, 7.4.3 are closed, valves 4.1, 4.3, 4.5, 6.7.1, 6.7.2, 6.7.3, 6.8.1, 6.8.2, 6.8.3, 7.7.1, 7.7.2, 7.7.3, 7.8.1, 7.8.2, 7.8.3 are opened, other valves are closed, the first circulation pump 1.1 and the second circulation pump 1.2 are started operate the first circulation loop 200 and the second circulation loop 300, the third circulation pump 1.3 is shut, the natural energy collector 2 is started, and the compressor 6.1, 7.1 are shut. That is, the operation of the refrigerant circulation loop 101 is shut. Under the circulation action of the first circulation pump 1.1, the cold/heat of the natural energy collector 2 passes through the natural energy collector 2, the valve 4.1, the main heat exchanger 3, the valve 4.3, the valve 6.6, valve 7.6, the refrigerating medium pipeline 6.5.1, the refrigerating medium pipeline 7.5.1, the first circulation pump 1.1, the natural energy collector 2 to form a circulation loop (at least one of valves 6.6, 7.6 needs to be opened to form a circulation loop). The first circulation loop 200 collects cold/heat, which is then transferred to the second circulation loop 300 at the main heat exchanger 3. Under the circulation action of the second circulation pump 1.2, the cold/heat obtained by the second circulation loop 300 at the main heat exchanger 3 passes through the main heat exchanger 3, the valve 4.5, the valve 6.7.1, the valve 6.7.2, the valve 6.7.3, the valve 7.7.1, the valve 7.7.2, the valve 7.7.3, the refrigerating medium pipeline 6.3.1.1, the refrigerating medium pipeline 6.3.2.1, the refrigerating medium pipeline 6.3.3.1, the refrigerating medium pipeline 7.3.1.1, the refrigerating medium pipeline 7.3.2.1, the refrigerating medium pipeline 7.3.3.1, the valve 6.8.1, the valve 6.8.2, the valve 6.8.3, the valve 7.8.1, the valve 7.8.2, the valve 7.8.3, the second circulation pump 1.2, and the main heat exchanger 3 to form a circulation loop. The cold/heat obtained by the second circulation loop 300 at the main heat exchanger 3 passes through the refrigerating medium pipeline 6.3.1.1, the refrigerating medium pipeline 6.3.2.1, the refrigerating medium pipeline 6.3.3.1, the refrigerating medium pipeline 7.3.1.1, the refrigerating medium pipeline 7.3.2.1, the refrigerating medium pipeline 7.3.3.1, and under the action of fans 6.3.1.3, 6.3.2.3, 6.3.3.3, 7.3.1.3, 7.3.2.3, 7.3.3.3, it is transferred to the air in the second air heat exchange channel 106 to form cold/hot air to meet the cooling/heating needs of the indoor room, thus achieving the free cooling/heating mode.

(6) The Process of the Defrosting Operation Mode is Described as Follows.

Figure 6:
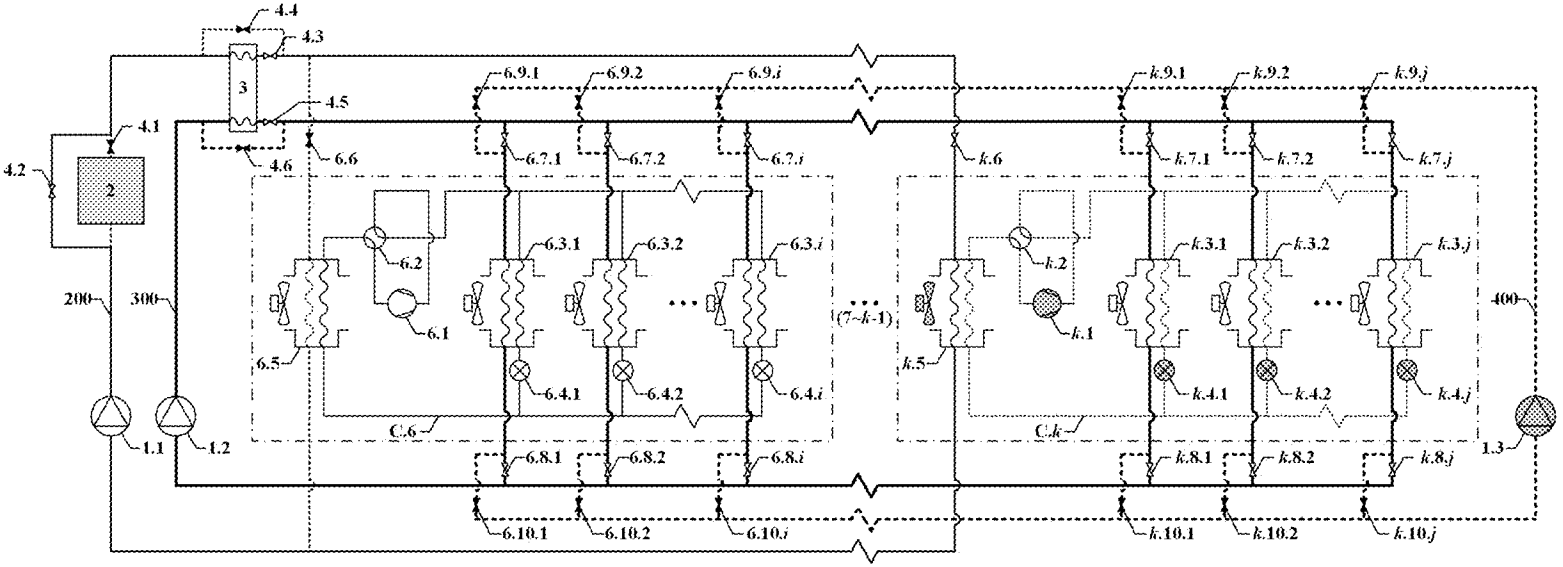
FIG. 6 is a schematic diagram of the defrosting operation mode implemented by the system of the present application.

As shown in FIG. 6, when the air source is used for heating and part of the outdoor air conditioning units need to be defrosted, assuming that the outdoor unit 7.5 needs to be defrosted, outdoor unit 6.5 does not need to be defrosted, and all six indoor units have heating demand. At this time, the compressor 7.1 is shut, the expansion valves 7.4.1, 7.4.2, and 7.4.3 are closed, the expansion valves 6.4.1, 6.4.2, and 6.4.3 are opened, and the valves 4.2, 4.3, 4.5, 6.7.1, 6.7.2, 6.7.3, 6.8.1, 6.8.2, 6.8.3, 7.7.1, 7.7.2, 7.7.3, 7.8.1, 7.8.2, 7.8.3 are opened while the other valves are closed. The first circulation pump 1.1 and the second circulation pump 1.2 are started to operate both the first circulation loop 200 and the second circulation loop 300, while the third circulation pump 1.3 is shut. The compressor 6.1 is started and the four-way valve 6.2 is adjusted to operate in the heating mode, so the indoor units 6.3.1, 6.3.2, 6.3.3 serve as the condensers, and outdoor unit 6.5 serves as the evaporator. Under the circulation action of the heat pump, when the condensation heat passes through the refrigerant pipelines 6.3.1.2, 6.3.2.2, 6.3.3.2, it is, on one hand, transferred to the air in the second air heat exchange channel 106 under the action of the fans 6.3.1.3, 6.3.2.3, 6.3.3.3, hot air is formed to meet the heating demand of the indoor rooms. On the other hand, the refrigerant pipelines 6.3.1.2, 6.3.2.2, 6.3.3.2 exchange heat with the refrigerating medium pipelines 6.3.1.1, 6.3.2.1, 6.3.3.1, to transfer the heat to the second circulation loop 300. Under the circulation action of the second circulation pump 1.2, the heat obtained at the refrigerating medium pipelines 6.3.1.1, 6.3.2.1, 6.3.3.1 passes through the refrigerating medium pipeline 6.3.1.1, the refrigerating medium pipeline 6.3.2.1, the refrigerating medium pipeline 6.3.3.1, the valve 6.8.1, the valve 6.8.2, the valve 6.8.3, the second circulation pump 1.2, the main heat exchanger 3, the valve 4.5, the valve 6.7.1, the valve 6.7.2, the valve 6.7.3, the valve 7.7.1, the valve 7.7.2, the valve 7.7.3, the refrigerating medium pipeline 6.3.1.1, the refrigerating medium pipeline 6.3.2.1, the refrigerating medium pipeline 6.3.3.1, the refrigerating medium pipeline 7.3.1.1, the refrigerating medium pipeline 7.3.2.1, and the refrigerating medium pipeline 7.3.3.1 to form a circulation loop. A part of the heat, when passing through the refrigerating medium pipeline 7.3.1.1, the refrigerating medium pipeline 7.3.2.1, and the refrigerating medium pipeline 7.3.3.1, is transferred to the air in the second air heat exchange channel 106 under the action of the fans 7.3.1.3, 7.3.2.3, 7.3.3.3, hot air is formed to meet the heating demand of the indoor room. when another part of the heat passes through the main heat exchanger 3, the main heat exchanger 3 exchanges heat with the first circulation loop 200, and heat is transferred to the first circulation loop 200. Under the circulation action of the first circulation pump 1.1, this part of the heat passes through the main heat exchanger 3, the valve 4.3, the valve 7.6, the refrigerating medium pipeline 7.5.1, the first circulation pump 1.1, valve 4.2, and the main heat exchanger 3 to form a circulation loop. The heat is used for defrosting at the refrigerating medium pipeline 7.5.1, achieving the defrost mode.

(7) The Process of a Low Load Rate Operation Mode is Described as Follows.

Figure 7:
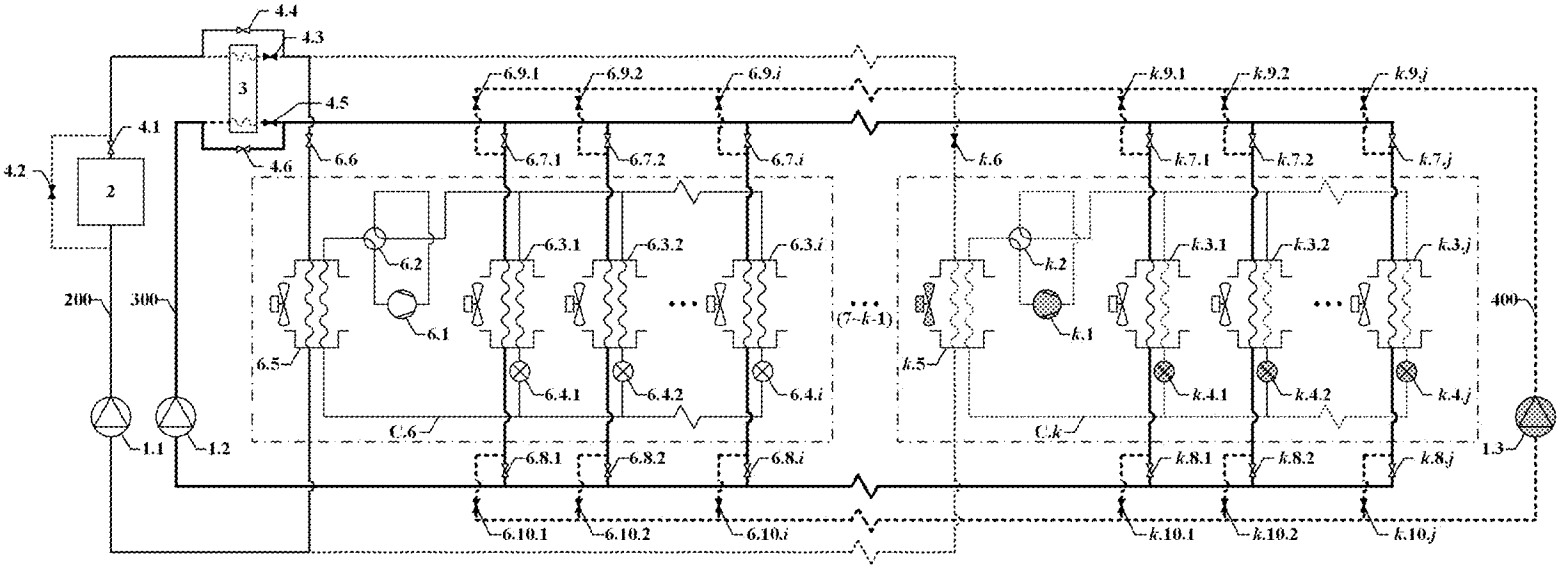
FIG. 7 is a schematic diagram of the low load rate operation mode implemented by the system of the present application.
Figure 8:
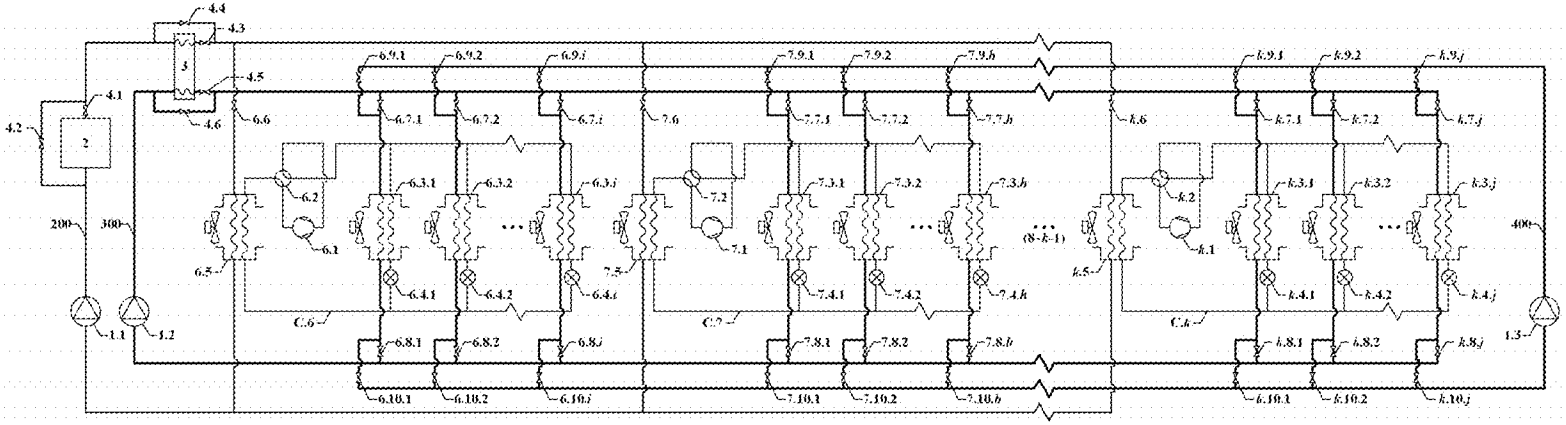
FIG. 8 is a schematic diagram of the embodiment of the present application.

As shown in FIG. 7, when multiple adjustable indoor units have cooling/heating demand and the indoor load is small, the example of low load rate mode for heating demand is given below. Assume that the air conditioning indoor units 6.3.1, 6.3.2, 6.3.3, 7.3.1, 7.3.2, 7.3.3 have heating demand, but each room has a small heat load. At this time, the compressor 7.1 is shut, the expansion valves 7.4.1, 7.4.2, 7.4.3 are opened, the expansion valves 6.4.1, 6.4.2, 6.4.3 are opened, the valves 4.6, 6.6, 6.7.1, 6.7.2, 6.7.3, 6.8.1, 6.8.2, 6.8.3, 7.7.1, 7.7.2, 7.7.3, 7.8.1, 7.8.2, 7.8.3 are opened, other valves are closed, the second circulation pump 1.2 is started to operate the second circulation loop 300, and the third circulation pump 1.3 is shut. The natural energy collector 2 is started, the compressor 6.1 is started, the four-way valve 6.2 is adjusted to operate in the heating mode, the indoor units 6.3.1, 6.3.2, 6.3.3 serve as the condenser, and the outdoor unit 6.5 serves as the evaporator. Under the circulation action of the heat pump, the heat produced when passing through the refrigerating medium pipelines 6.3.1.2, 6.3.2.2, 6.3.3.2, on the one hand, under the action of the fan 6.3.1.3, 6.3.2.3, 6.3.3.3, is transferred to the air in the second air heat exchange channel 106, hot air is formed to provide heating demand for indoor rooms. On the other hand, the refrigerating medium pipelines 6.3.1.2, 6.3.2.2, 6.3.3.2 exchange heat with the refrigerant pipelines 6.3.1.1, 6.3.2.1, 6.3.3.1, heat is transferred to the second circulation loop 300. Under the circulation action of the second circulation pump 1.2, the heat obtained at the refrigerating medium pipelines 6.3.1.1, 6.3.2.1, 6.3.3.1 passes through the refrigerating medium pipeline 6.3.1.1, the refrigerating medium pipeline 6.3.2.1, the refrigerating medium pipeline 6.3.3.1, the valve 6.8.1, the valve 6.8.2, the valve 6.8.3, the second circulation pump 1.2, the valve 4.6, the valve 6.7.1, the valve 6.7.2, the valve 6.7.3, the valve 7.7.1, the valve 7.7.2, the valve 7.7.3, the refrigerating medium pipeline 6.3.1.1, the refrigerating medium pipeline 6.3.2.1, the refrigerating medium pipeline 6.3.3.1, the refrigerating medium pipeline 7.3.1.1, the refrigerating medium pipeline 7.3.2.1, the refrigerating medium pipeline 7.3.3.1, the valve 6.8.1, the valve 6.8.2, the valve 6.8.3, the valve 7.8.1, the valve 7.8.2, the valve 7.8.3, and the second circulation pump 1.2 to form a circulation loop. The heat, when passing through the refrigerating medium pipeline 7.3.1.1, the refrigerating medium pipeline 7.3.2.1, the refrigerating medium pipeline 7.3.3.1, under the action of fans 7.3.1.3, 7.3.2.3, 7.3.3.3, is transferred to the air in the second air heat exchange channel 106, hot air is formed to provide heating demand for indoor rooms, and the low load rate mode. Similarly, this system can also have the above functions by only turning on the compressor 7.1 to provide the low load rate mode; likewise, this system can also meet the cooling demand and provide a low load rate mode. The low load rate mode concentrates the load into a smaller number of heat pump units, and the load rate of the unit is improved, which is beneficial to enhance the efficiency of the unit.

Further, when a third circulation loop 400 is added to the system, a more comprehensive operation mode can be achieved. As shown in the attached FIGS. 8 and 17, the following system operation mode diagrams show three air conditioning units 100, one of which is C.6, the second one is C.7, and the last one is C.k. In this embodiment, it is assumed that there are three air conditioning units 100 in the system, each of which has an outdoor heat exchanger 102 and three indoor heat exchangers 103. The outdoor heat exchangers 102 include air conditioning outdoor units 6.5, 7.5, 8.5, and the indoor heat exchangers 103 include air conditioning indoor units 6.3.1, 6.3.2, 6.3.3, 7.3.1, 7.3.2, 7.3.3, 8.3.1, 8.3.2, 8.3.3. The first medium channels 104 in the air conditioning outdoor units 6.5, 7.5, and 8.5 are refrigerant pipelines 6.5.2, 7.5.2, 8.5.2, respectively, and the second medium channels 105 are refrigerating medium pipelines 6.5.1, 7.5.1, 8.5.1, respectively. The first medium channels 104 in the air conditioning indoor units 6.3.1, 6.3.2, 6.3.3, 7.3.1, 7.3.2, 7.3.3, 8.3.1, 8.3.2, 8.3.3 are refrigerant pipelines 6.3.1.2, 6.3.2.2, 6.3.3.2, 7.3.1.2, 7.3.2.2, 7.3.3.2, 8.3.1.2, 8.3.2.2, 8.3.3.2, respectively, and the second medium channels 105 are refrigerating medium pipelines 6.3.1.1, 6.3.2.1, 6.3.3.1, 7.3.1.1, 7.3.2.1, 7.3.3.1, 8.3.1.1, 8.3.2.1, 8.3.3.1, respectively. The remaining valves are as described below, and the specific operation modes that can be achieved are described as follows.

(8) The Process of the "Low Load Rate Heating+Natural Energy Free Cooling" Operation Mode is Described as Follows.

Figure 9:
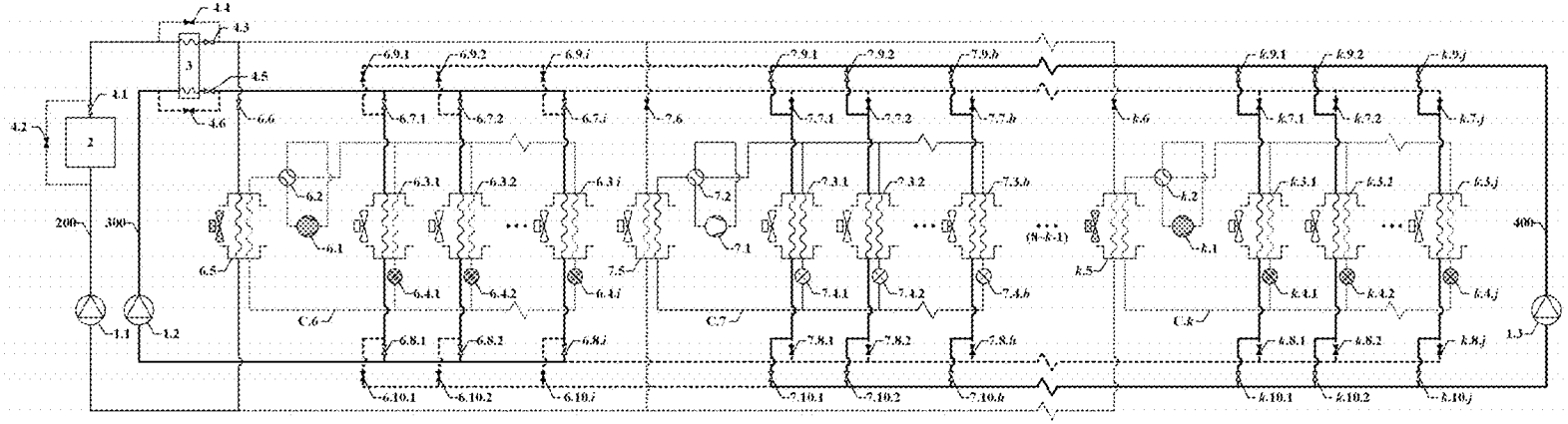
FIG. 9 is a schematic diagram of the heating low load rate+natural energy free cooling operation mode implemented by the system of the present application.

As shown in FIG. 9, when some rooms need heating, some rooms need cooling, and the heating load in the room is small, and the natural energy parameters are appropriate, it is assumed that the air conditioning indoor units 6.3.1, 6.3.2, 6.3.3 have cooling demand, and air conditioning indoor units 7.3.1, 7.3.2, 7.3.3, 8.3.1, 8.3.2, 8.3.3 have heating demand. Valves 4.1, 4.3, 4.5, 6.6, 6.7.1, 6.7.2, 6.7.3, 6.8.1, 6.8.2, 6.8.3, 7.9.1, 7.9.2, 7.9.3, 7.10.1, 7.10.2, 7.10.3, 8.9.1, 8.9.2, 8.9.3, 8.10.1, 8.10.2, 8.10.3 are opened, and other valves are closed. Compressors 6.1, 8.1 are shut, expansion valves 7.4.1, 7.4.2, 7.4.3 are opened, and expansion valves 6.4.1, 6.4.2, 6.4.3, 8.4.1, 8.4.2, 8.4.3 are closed. The first circulation pump 1.1, the second circulation pump 1.2, and the third circulation pump 1.3 are started to operate the first circulation loop 200, the second circulation loop 300, and the third circulation loop 400. Also, the natural energy collector 2 is started, the compressor 7.1 is started, and the four-way valve 7.2 is adjusted to operate the system in heating mode, so that the air conditioning indoor units 7.3.1, 7.3.2, 7.3.3 serves as condensers, and the outdoor unit 7.5 serves as an evaporator. Under the circulation action of the heat pump, the heat produced passes through the refrigerant pipelines 7.3.1.2, 7.3.2.2, 7.3.3.2. On one hand, under the action of fans 7.3.1.3, 7.3.2.3, 7.3.3.3, the heat is transferred to the air in the second air heat exchanger channel 106, hot air is formed to provide heating needs for indoor rooms. On the other hand, refrigerating medium pipelines 7.3.1.2, 7.3.2.2, 7.3.3.2 exchange heat with refrigerant pipelines 7.3.1.1, 7.3.2.1, 7.3.3.1, the heat is transferred to the third circulation loop 400. Under the circulation action of the third circulation pump 1.3, the heat obtained at the refrigerating medium pipelines 7.3.1.1, 7.3.2.1, 7.3.3.1 passes through refrigerating medium pipelines 7.3.1.1, 7.3.2.1, 7.3.3.1, valves 7.10.1, 7.10.2, 7.10.3, the third circulation pump 1.3, valves 7.9.1, 7.9.2, 7.9.3, valves 8.9.1, 8.9.2, 8.9.3, refrigerating medium pipelines 7.3.1.1, 7.3.2.1, 7.3.3.1, refrigerating medium pipelines 8.3.1.1, 8.3.2.1, 8.3.3.1, valves 7.10.1, 7.10.2, 7.10.3, valves 8.10.1, 8.10.2, 8.10.3, third circulation pump 1.3 to form a circulation loop. The heat passes through refrigerating medium pipelines 8.3.1.1, 8.3.2.1, 8.3.3.1 and under the action of fans 8.3.1.3, 8.3.2.3, 8.3.3.3, it is transferred to the air in the third air heat exchanger channel 107, and hot air is formed to provide heating needs for indoor rooms. Under the circulation action of the first circulation pump 1.1, the cold of natural energy passes through the natural energy collector 2, valve 4.1, the main heat exchanger 3, the valve 4.3, the valve 6.6, the refrigerating medium pipeline 6.5.1, the first circulation pump 1.1, and the natural energy collector 2 to form a circulation loop (at least one of valves 6.6 and 8.6 needs to be opened to form a circulation loop), and the first circulation loop 200 collects cold. The cold is transferred to the second circulation loop 300 when passing through the main heat exchanger 3. Under the circulation action of the second circulation pump 1.2, the cold obtained by the second circulation loop 300 at the main heat exchanger 3 passes through the main heat exchanger 3, the valve 4.5, the valve 6.7.1, the valve 6.7.2, the valve 6.7.3, the refrigerating medium pipeline 6.3.1.1, the refrigerating medium pipeline 6.3.2.1, the refrigerating medium pipeline 6.3.3.1, the valve 6.8.1, the valve 6.8.2, the valve 6.8.3, the second circulation pump 1.2, and the main heat exchanger 3 to form a circulation loop. When the cold obtained by the second circulation loop 300 at the main heat exchanger 3 passes through the refrigerating medium pipeline 6.3.1.1, the refrigerating medium pipeline 6.3.2.1, and the refrigerating medium pipeline 6.3.3.1, it is transferred to the air in the second air heat exchange channel 106 under the action of fans 6.3.1.3, 6.3.2.3, and 6.3.3.3, cold air is formed to provide cooling for indoor rooms, realizing the free cooling mode of natural energy. In combination, the system can achieve the "low load rate heating+natural energy free cooling" mode. On the one hand, the low load rate heating mode concentrates the load into fewer heat pump units, and the load rate of the unit is improved, which is beneficial to enhance the energy efficiency of the unit. On the other hand, free cooling using natural energy can save the energy consumption of the heat pump unit used for refrigeration.

(9) The Process of the "Low Load Rate Heating+Evaporator Free Cooling" Operation Mode is Described as Follows.

Figure 10:
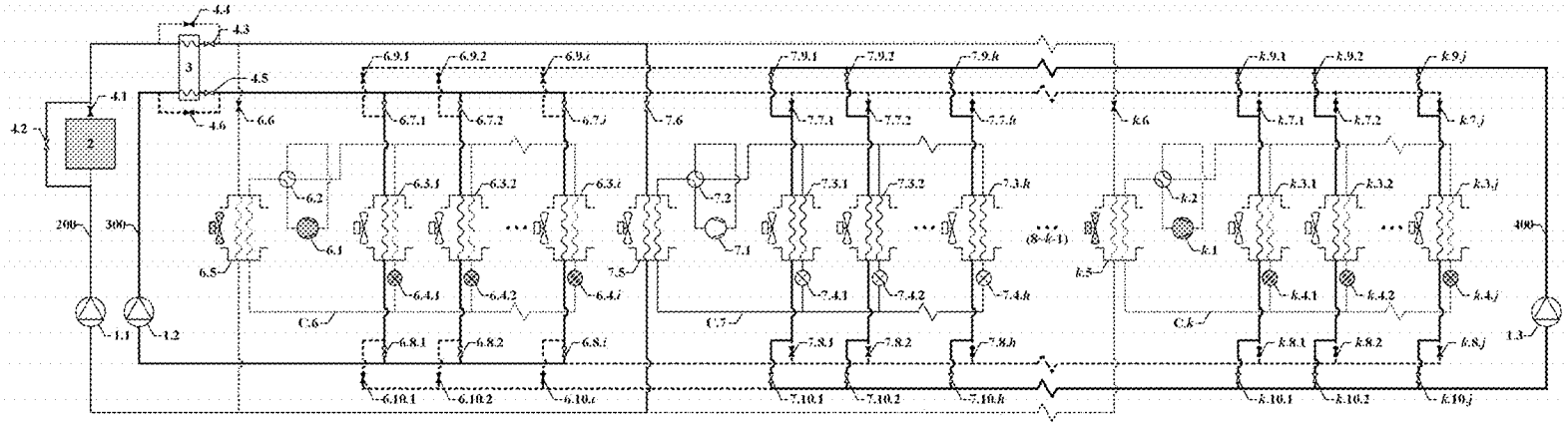
FIG. 10 is a schematic diagram of the heating low load rate+evaporator free cooling operation mode implemented by the system of the present application.

As shown in FIG. 10, when some rooms need heating, some rooms need cooling, and the room heating load is low, air conditioning indoor units 6.3.1, 6.3.2, 6.3.3 are taken as examples that have cooling demand, and air conditioning indoor units 7.3.1, 7.3.2, 7.3.3, 8.3.1, 8.3.2, 8.3.3 have heating demand. Valves 4.2, 4.3, 4.5, 7.6, 6.7.1, 6.7.2, 6.7.3, 6.8.1, 6.8.2, 6.8.3, 7.9.1, 7.9.2, 7.9.3, 7.10.1, 7.10.2, 7.10.3, 8.9.1, 8.9.2, 8.9.3, 8.10.1, 8.10.2, 8.10.3 are opened, and other valves are closed. The natural energy collector 2 is shut, and compressors 6.1 and 8.1 are shut. Expansion valves 7.4.1, 7.4.2, 7.4.3 are opened, and expansion valves 6.4.1, 6.4.2, 6.4.3, 8.4.1, 8.4.2, 8.4.3 are closed. The first circulation pump 1.1, the second circulation pump 1.2, and the third circulation pump 1.3 are started, so that the first circulation loop 200, the second circulation loop 300, and the third circulation loop 400 can all operate. The compressor 7.1 is started, and four-way valve 7.2 is adjusted to operate in the heating mode. Indoor units 7.3.1, 7.3.2, 7.3.3 serve as the condenser, and outdoor unit 7.5 serves as the evaporator. Under the circulation action of the heat pump, the heat generated, when passing through the refrigerant pipelines 7.3.1.2, 7.3.2.2, 7.3.3.2, on the one hand, is transferred to the air in the second air heat exchange channel 106 under the action of fans 7.3.1.3, 7.3.2.3, 7.3.3.3, hot air is formed to provide heating for indoor rooms. On the other hand, refrigerant pipelines 7.3.1.2, 7.3.2.2, 7.3.3.2 exchange heat with the refrigerating medium pipelines 7.3.1.1, 7.3.2.1, 7.3.3.1, transfer the heat to the third circulation loop 400. Under the circulation action of the third circulation pump 1.3, the heat obtained at the refrigerating medium pipelines 7.3.1.1, 7.3.2.1, 7.3.3.1 passes through refrigerating medium pipelines 7.3.1.1, 7.3.2.1, 7.3.3.1, valves 7.10.1, 7.10.2, 7.10.3, third circulation pump 1.3, valves 7.9.1, 7.9.2, 7.9.3, valves 8.9.1, 8.9.2, 8.9.3, refrigerating medium pipelines 7.3.1.1, 7.3.2.1, 7.3.3.1, refrigerating medium pipelines 8.3.1.1, 8.3.2.1, 8.3.3.1, valves 7.10.1, 7.10.2, 7.10.3, valves 8.10.1, 8.10.2, 8.10.3, third circulation pump 1.3 to form a circulation loop. The heat, when passing through the refrigerating medium pipelines 8.3.1.1, 8.3.2.1, 8.3.3.1, is transferred to the air in the second air heat exchange channel 106 under the action of fans 8.3.1.3, 8.3.2.3, 8.3.3.3, hot air is formed to provide heating for indoor rooms, achieving the low load rate heating mode. The cold generated by the outdoor unit 7.5 serving as the evaporator is transferred from the refrigerant pipeline 7.5.2 to the refrigerating medium pipeline 7.5.1 through heat exchange. Under the circulation action of the first circulation pump 1.1, the cold of the refrigerating medium pipeline 7.5.1 passes through refrigerating medium pipeline 7.5.1, the first circulation pump 1.1, the valve 4.2, the main heat exchanger 3, the valve 4.3, the valve 7.6, the refrigerating medium pipeline 7.5.1 to form a circulation loop, and the first circulation loop 200 collects the cold. The cold is transferred to the second circulation loop 300 when it passes through the main heat exchanger 3. Under the circulation action of the second circulation pump 1.2, the cold obtained by the refrigerating medium pipelines at the main heat exchanger 3 passes through the main heat exchanger 3, the valve 4.5, the valves 6.7.1, 6.7.2, 6.7.3, refrigerating medium pipelines 6.3.1.1, 6.3.2.1, 6.3.3.1, valves 6.8.1, 6.8.2, 6.8.3, the second circulation pump 1.2, the main heat exchanger 3 to form a circulation loop. The cold obtained by the second circulation loop 300 at the main heat exchanger 3, when passing through refrigerating medium pipelines 6.3.1.1, 6.3.2.1, 6.3.3.1, is respectively transferred to the air in the second air heat exchange channel 106 under the action of fans 6.3.1.3, 6.3.2.3, 6.3.3.3, cold air is formed to provide cooling for indoor rooms, and the evaporator free cooling mode. In summary, this system can achieve the "low load rate heating+evaporator free cooling" mode. On the one hand, the low load rate heating mode concentrates the load into a smaller number of heat pump units, and the load rate of the units is improved, which is beneficial for enhancing the energy efficiency of the units. On the other hand, the cold produced by the evaporator during heating of the heat pump unit is used for free cooling, saving the energy consumption of the heat pump unit used for cooling.

(10) The Process of the "Low Load Rate Heating+Low Load Rate Cooling" Operation Mode is Described as Follows.

Figure 11:
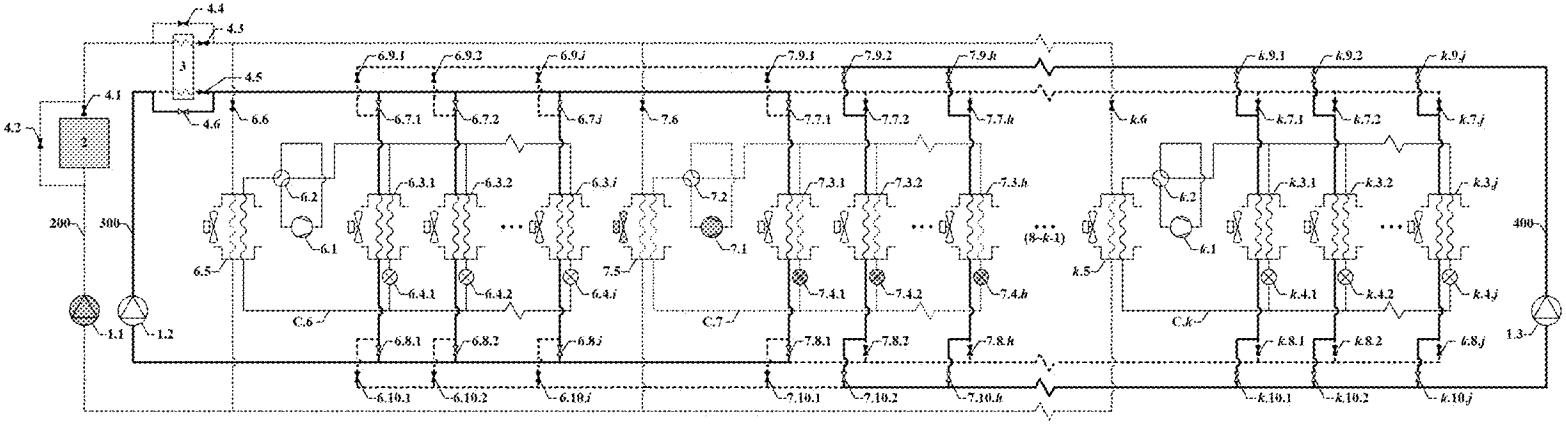
FIG. 11 is a schematic diagram of the heating low load rate+cooling low load rate operation mode implemented by the system of the present application.
Figure 12:
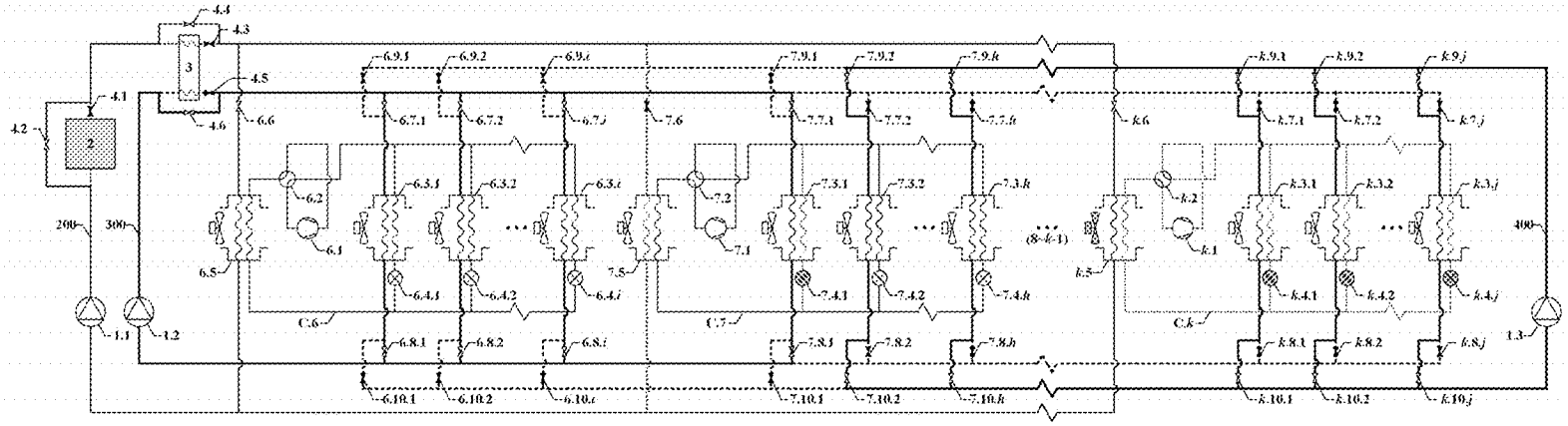
FIG. 12 is a schematic diagram of the cooling low load rate+heating defrost operation mode implemented by the system of the present application.

As shown in FIG. 11, when some rooms need heating, some rooms need cooling, and when the cooling and heating loads of the rooms are relatively low, the indoor units 6.3.1, 6.3.2, 6.3.3, 7.3.1 with cooling demand, and indoor units 7.3.2, 7.3.3, 8.3.1, 8.3.2, 8.3.3 with heating demand are taken as examples. Valves 4.6, 6.7.1, 6.7.2, 6.7.3, 6.8.1, 6.8.2, 6.8.3, 7.7.1, 7.8.1, 7.9.2, 7.9.3, 7.10.2, 7.10.3, 8.9.1, 8.9.2, 8.9.3, 8.10.1, 8.10.2, 8.10.3 are opened, other valves are closed, the natural energy collector 2 is shut, the compressor 7.1 is shut, expansion valves 6.4.1, 6.4.2, 6.4.3, 8.4.1, 8.4.2, 8.4.3 are opened, expansion valves 7.4.1, 7.4.2, 7.4.3 are closed, and the first circulation pump 1.1, turn on the second circulation pump 1.2 and the third circulation pump 1.3 are shut, and both the second circulation loop 300 and the third circulation loop 400 operate. The compressor 6.1 is started, the four-way valve 6.2 is adjusted to operate in cooling mode, where indoor units 6.3.1, 6.3.2, 6.3.3 serve as the evaporator, and the outdoor unit 6.5 serves as the condenser; the compressor 8.1 is started, the four-way valve 8.2 is adjusted to operate in heating mode, where indoor units 8.3.1, 8.3.2, 8.3.3 serve as the condensers, and the outdoor unit 8.5 serves as the evaporator. Under the circulation action of the heat pump, the cold produced by compressor 6.1 passes through the refrigerant pipelines 6.3.1.2, 6.3.2.2, 6.3.3.2. On one hand, under the action of the fan 6.3.1.3, 6.3.2.3, 6.3.3.3, it is transferred to the air in the second air heat exchange channel 106, cold air is formed to provide cooling demand for the indoor rooms. On the other hand, the refrigerant pipelines 6.3.1.2, 6.3.2.2, 6.3.3.2 exchange heat with the refrigerating medium pipelines 6.3.1.1, 6.3.2.1, 6.3.3.1, and transfer the cold to the second circulation loop 300. Under the circulation action of the second circulation pump 1.2, the cold obtained at the refrigerating medium pipeline 6.3.1.1, 6.3.2.1, 6.3.3.1 passes through the refrigerating medium pipeline 6.3.1.1, the refrigerating medium pipeline 6.3.2.1, the refrigerating medium pipeline 6.3.3.1, the valve 6.8.1, the valve 6.8.2, the valve 6.8.3, the second circulation pump 1.2, the valve 4.6, the valve 6.7.1, the valve 6.7.2, the valve 6.7.3, the valve 7.7.1, the refrigerating medium pipeline 6.3.1.1, the refrigerating medium pipeline 6.3.2.1, the refrigerating medium pipeline 6.3.3.1, the refrigerating medium pipeline 7.3.1.1, valve 6.8.1, valve 6.8.2, valve 6.8.3, valve 7.8.1, and the second circulation pump 1.2 to form a circulation loop. As the cold passes through the refrigerant pipeline 7.3.1.1, under the action of the fan 7.3.1.3, it is transferred to the air heat exchange in the second air heat exchange channel 106, cold air is formed to provide cooling needs for the indoor room and the low load rate cooling mode. Furthermore, under the circulation action of the heat pump, the heat produced by the compressor 8.1 passes through the refrigerant pipelines 8.3.1.2, 8.3.2.2, 8.3.3.2. On the one hand, under the action of the fans 8.3.1.3, 8.3.2.3, 8.3.3.3, it is transferred to the air in the second air heat exchange channel 106, hot air is formed to meet the heating needs of the indoor room. On the other hand, the refrigerant pipelines 8.3.1.2, 8.3.2.2, 8.3.3.2 respectively exchange heat with the refrigerating medium pipelines 8.3.1.1, 8.3.2.1, 8.3.3.1, and transfer the heat to the third circulation loop 400. Under the circulation action of the third circulation pump 1.3, the heat obtained at the refrigerating medium pipelines 8.3.1.1, 8.3.2.1, 8.3.3.1 passes through the refrigerating medium pipelines 8.3.1.1, 8.3.2.1, 8.3.3.1, the valve 8.10.1, the valve 8.10.2, the valve 8.10.3, the third circulation pump 1.3, the valve 7.9.2, the valve 7.9.3, the valve 8.9.1, the valve 8.9.2, the valve 8.9.3, the refrigerating medium pipeline 7.3.2.1, the refrigerating medium pipeline 7.3.3.1, the refrigerating medium pipeline 8.3.1.1, the refrigerating medium pipeline 8.3.2.1, the refrigerating medium pipeline 8.3.3.1, the valve 7.10.2, the valve 7.10.3, the valve 8.10.1, the valve 8.10.2, the valve 8.10.3, and the third circulation pump 1.3 to form a circulation loop. When passing through the refrigerating medium pipelines 7.3.2.1, 7.3.3.1, under the action of the fans 7.3.2.3, 7.3.3.3, the heat is transferred to the air in the second air heat exchange channel 106, hot air is formed to provide the heating needs of the indoor room and the low load rate heating mode. By integrating the two, the system can achieve the "low load rate heating+low load rate cooling" mode. This mode concentrates the load into a smaller number of heat pump units, improving the load rate of the units, which is beneficial for improving the energy efficiency of the units.

(11) The Process of the "Cooling Low Load Rate+Heating Defrost" Mode is Described as Follows:

Based on the "heating low load rate+cooling low load rate" mode in FIG. 11, after the compressor 8.1 in heating mode has been running for a period of time, the outdoor unit 8.5 may frost. At this time, valves 4.2, 4.4, 6.6, and 8.6 are opened, and the first circulation pump 1.1 is started. Under the circulation action of the first circulation pump 1.1, the heat produced by the air conditioning outdoor unit 6.5 as a condenser passes through the refrigerating medium pipeline 6.5.1, the first circulation pump 1.1, the valve 4.2, the valve 4.4, the valve 6.6, the valve 8.6, the refrigerating medium pipeline 6.5.1, the refrigerating medium pipeline 8.5.1, and the first circulation pump 1.1 to form a circulation loop. The heat at the refrigerating medium pipeline 8.5.1 is used for defrosting to provide the heating defrost mode. Combining the "heating low load rate+cooling low load rate" mode in FIG. 11, FIG. 12 can achieve the "cooling low load rate+heating defrost" mode, which reduces the energy required for defrosting and improves the reliability of heating.

Figure 13:
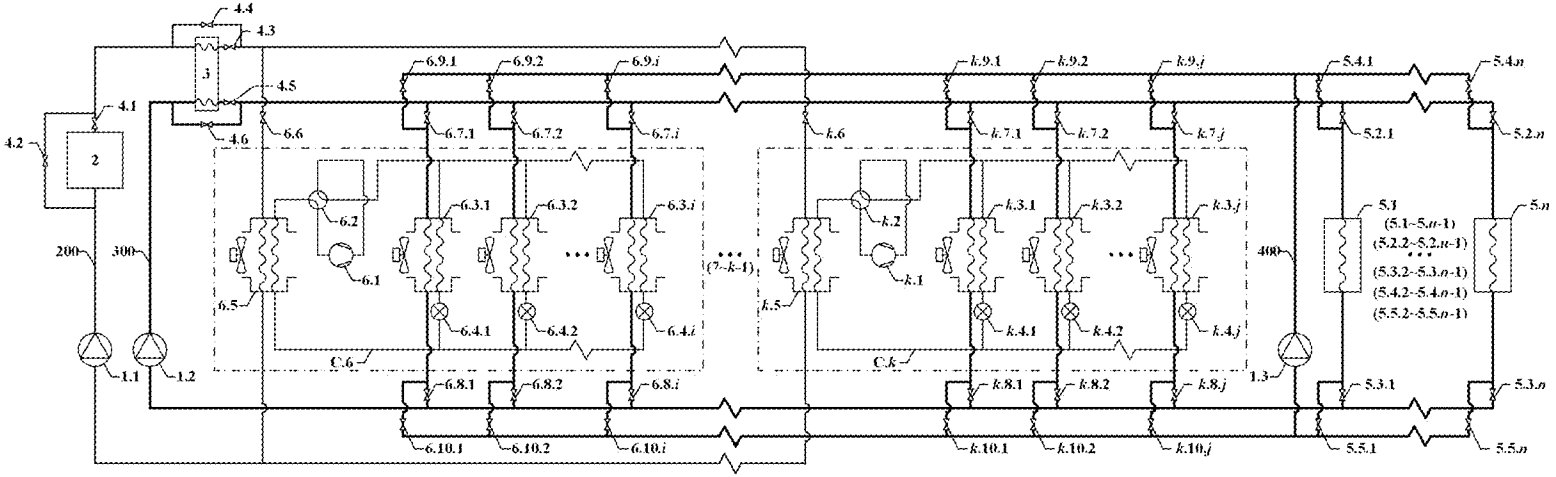
FIG. 13 is a schematic structural diagram of the intermittent heating function implemented by the system of the present application.

In addition, as shown in FIG. 13, to intermittently heating the room, this embodiment further includes multiple heat exchangers. The heat exchangers are connected in parallelly and communicate with the second circulation loop 300 and the third circulation loop 400. The communication and closure between the heat exchanger and the second circulation loop 300 and between the heat exchanger and the third circulation loop 400 are controlled by disposing valves. The heat exchangers are at least one of ceiling-type heat radiators, wall-type heat radiators, floor-type heat radiators, and liquid heat storages. By increasing the heat exchangers, the system can achieve the following operation modes:

(12) The Operation Process of the Start-Up of the "Intermittent Heating" Mode is Described as Follows.

Figure 14:
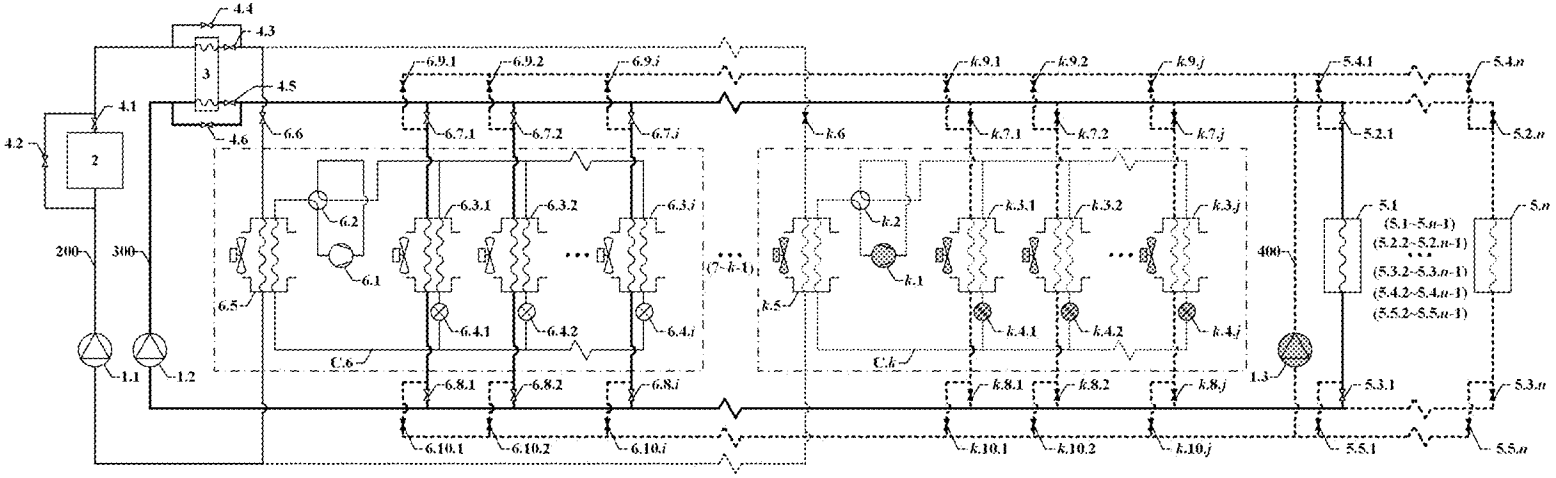
FIG. 14 is a schematic diagram of the system of the present application in the start-up phase of the intermittent heating mode.

As shown in FIG. 14, it is assumed that there are two heat exchangers and two air conditioning units 100, each air conditioning unit 100 has three air conditioning indoor units. Taking air conditioning indoor units 6.3.1, 6.3.2, 6.3.3, and heat exchanger 5.1 belonging to the same room (first room), and air conditioning indoor units 7.3.1, 7.3.2, 7.3.3, and heat exchanger 5.2 belonging to the same room (second room) as an example. Taking the first room having a heating demand, and the second room having no heating demand as an example. The compressor 6.1 is started, the four-way valve 6.2 is adjusted to operate in the heating mode, indoor units 6.3.1, 6.3.2, 6.3.3 serve as the condenser, and outdoor unit 6.5 serve as the evaporator. Under the circulation action of the heat pump, the heat produced passes through the refrigerant pipelines 6.3.1.2, 6.3.2.2, 6.3.3.2. On the one hand, under the action of fans 6.3.1.3, 6.3.2.3, 6.3.3.3, it transfers to the air in the second air heat exchanger channel 106, hot air is formed to provide heating for the indoor room, satisfying the need for a fast response. On the other hand, refrigerant pipelines 6.3.1.2, 6.3.2.2, 6.3.3.2 exchange heat with refrigerating medium pipelines 6.3.1.1, 6.3.2.1, 6.3.3.1, and transfer the heat to the second circulation loop 300. Under the circulation action of the second circulation pump 1.2, the heat obtained at the refrigerating medium pipelines 6.3.1.1, 6.3.2.1, 6.3.3.1 passes through the refrigerating medium pipelines 6.3.1.1, 6.3.2.1, 6.3.3.1, valves 6.8.1, 6.8.2, 6.8.3, the second circulation pump 1.2, valves 4.6, 6.7.1, 6.7.2, 6.7.3, valve 5.2.1, the refrigerating medium pipelines 6.3.1.1, 6.3.2.1, 6.3.3.1, heat exchanger 5.1, valves 6.8.1, 6.8.2, 6.8.3, valve 5.3.1, and the second circulation pump 1.2 to form a circulation loop. The heat passes through the heat exchanger 5.1 and provides heating for the indoor room through radiation. Similarly, when only the second room has heating demand, or when both the first and the second rooms have heating demand, the above functions can also be achieved by only starting compressor 7.1 or by starting both compressors 6.1 and 7.1 at the same time. This will not be further repeated here. Similarly, when a room has a cooling demand, the above functions can also be achieved, and this will not be further repeated here. Similarly, when the first and second rooms have different heating/cooling demands, such as when the first room has a heating demand, and the second room has a cooling demand, the above functions can be achieved in conjunction with the operation modes shown in FIG. 10 to FIG. 13, and this will not be further repeated here. Similarly, if people stay indoors for a short period, and they leave before the temperature at the terminal of the radiation heat exchange reaches the target temperature, then the system can just generate hot air in the start-up stage, without supplying hot water to the radiation heating terminal, and this will not be further repeated here. Similarly, not all indoor units in each room necessarily need to be started, the system can just turn on some of them to achieve the above functions, and this will not be further repeated here. Similarly, each room is not limited to having only one radiation heat exchange device (such as: Heat exchanger 5.1), when a room is provided with multiple heat exchangers, the above functions can also be achieved, and this will not be further repeated here. In the start-up stage of the intermittent heating mode, this system can both generate hot air and hot water, the speed of raising the indoor temperature with hot air is relatively fast, but due to thermal inertia, the speed of raising the indoor temperature by letting hot water enter the radiation heat exchange terminal is slower. When the room was not previously heated and the room temperature is relatively low, in order to rapidly increase the indoor temperature, the system uses the blown hot air for rapid heating, while the generated hot water slowly raises the indoor temperature by entering the radiation heating terminal, both of them work together to raise the temperature.

Figure 15:
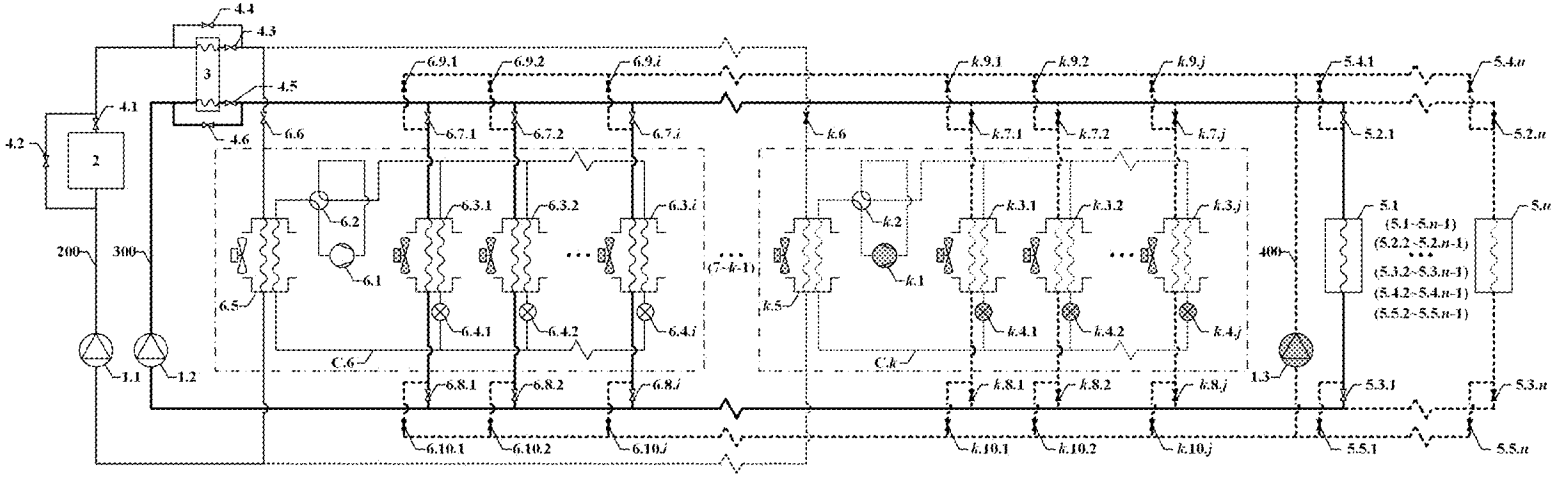
FIG. 15 is a schematic diagram of the system of the present application in the stable phase of the intermittent heating mode.

(12) The Operation Process of a Stable Phase of the "Intermittent Heating" Mode is Described as Follows:

As shown in FIG. 15, it is assumed that there are two heat exchangers and two air conditioning units 100, and each air conditioning unit has three indoor units. Taking indoor unit 6.3.1, indoor unit 6.3.2, indoor unit 6.3.3, heat exchanger 5.1 belonging to the same room (the first room), indoor unit 7.3.1, indoor unit 7.3.2, indoor unit 7.3.3, heat exchanger 5.2 belonging to the same room (the second room) as an example, and taking the first room having a heating demand and the second room without a heating demand as an example. Based on the operation of the intermittent heating mode start-up phase in FIG. 12, when the indoor temperature reaches or is close to the required temperature, the fans 6.3.1.3, 6.3.2.3, 6.3.3.3 are shut; under the circulation action of the heat pump, the generated heat passes through the refrigerant pipelines 6.3.1.2, 6.3.2.2, 6.3.3.2, the refrigerant pipelines 6.3.1.2, 6.3.2.2, 6.3.3.2 exchange heat with the refrigerating medium pipelines 6.3.1.1, 6.3.2.1, 6.3.3.1, and transfer the heat to the second circulation loop 300. Under the circulation action of the second circulation pump 1.2, the heat obtained at the refrigerating medium pipelines 6.3.1.1, 6.3.2.1, 6.3.3.1 passes through the refrigerating medium pipeline 6.3.1.1, the refrigerating medium pipeline 6.3.2.1, the refrigerating medium pipeline 6.3.3.1, the valve 6.8.1, the valve 6.8.2, the valve 6.8.3, the second circulation pump 1.2, the valve 4.6, the valve 6.7.1, the valve 6.7.2, the valve 6.7.3, the valve 5.2.1, the refrigerating medium pipeline 6.3.1.1, the refrigerating medium pipeline 6.3.2.1, the refrigerating medium pipeline 6.3.3.1, the heat exchanger 5.1, the valve 6.8.1, the valve 6.8.2, the valve 6.8.3, the valve 5.3.1, second circulation pump 1.2 to form a circulation loop, and the heat passes through the heat exchanger 5.1 to provide the heating demand by radiating heat to the indoor room. Through this mode, radiant heating is used to meet the indoor comfort demand in the stable phase. Similarly, when only the second room has a heating demand, or both the first and second rooms have heating demands, the above functions can be achieved by only starting the compressor 7.1 or starting both compressors 6.1 and 7.1 at the same time, this will not be further repeated here. Similarly, when the room has a cooling demand, the above functions can also be achieved, and this will not be further repeated here. Similarly; when the first and second rooms have different heating/cooling demands, such as when the first room has a heating demand and the second room has a cooling demand, the above functions can be achieved in conjunction with the operation modes shown in FIGS. 10 to 13, and this will not be further repeated here. Similarly, each room is not limited to having only one radiation heat exchange device (such as: heat exchanger 5.1), when a room has multiple heat exchangers, the above functions can also be achieved, and this will not be further repeated here. After the start-up phase of the intermittent heating mode, the temperature at the terminal of the radiation heat exchange that has hot water flowing in has reached the target temperature, entering the stable phase of the intermittent heating mode, at this time there is no need to send in hot air, only through the radiation heating terminal to bear the heat load; Because the temperature grade required for radiant heating is lower than that of hot air, therefore when there is no need to send in hot air, the temperature grade supplied by the heat pump unit can be reduced, which is beneficial to improve the unit efficiency and reduce energy consumption.

For the two modes of the start-up phase of the Intermittent Heating mode shown in FIG. 14 and the stable phase of Intermittent Heating mode shown in FIG. 15, the start-up phase primarily employs hot air for rapid response. After stably running, it mainly uses chilled and hot water radiation for heating and cooling. The stable phase can use a lower grade of energy to reduce energy consumption. Therefore, these two modes can avoid the disadvantage of radiative heating being inconvenient to shut off due to large thermal inertia, achieving intermittent operation of radiative cooling/heating.

Figure 16:
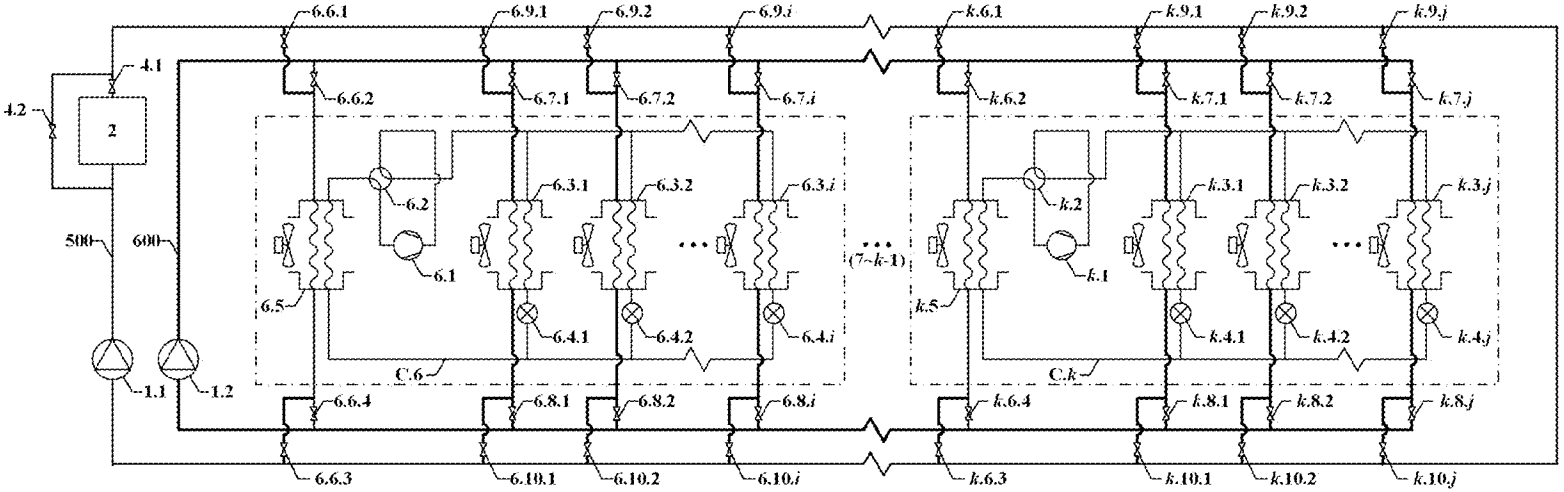
FIG. 16 is a schematic diagram of another embodiment of the system of the present application.
Figure 17:
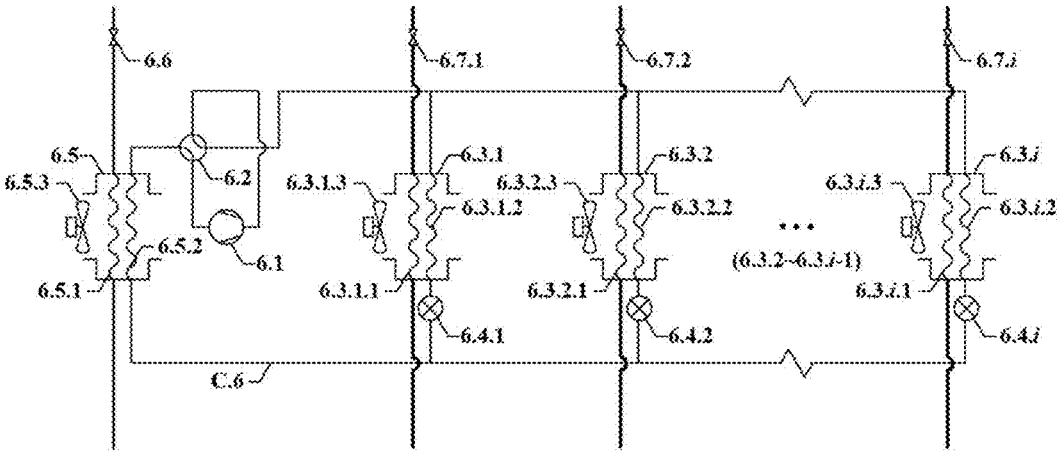
FIG. 17 is a schematic structural diagram of the structure of each air conditioning unit in the system of the present application.
Figure 17:
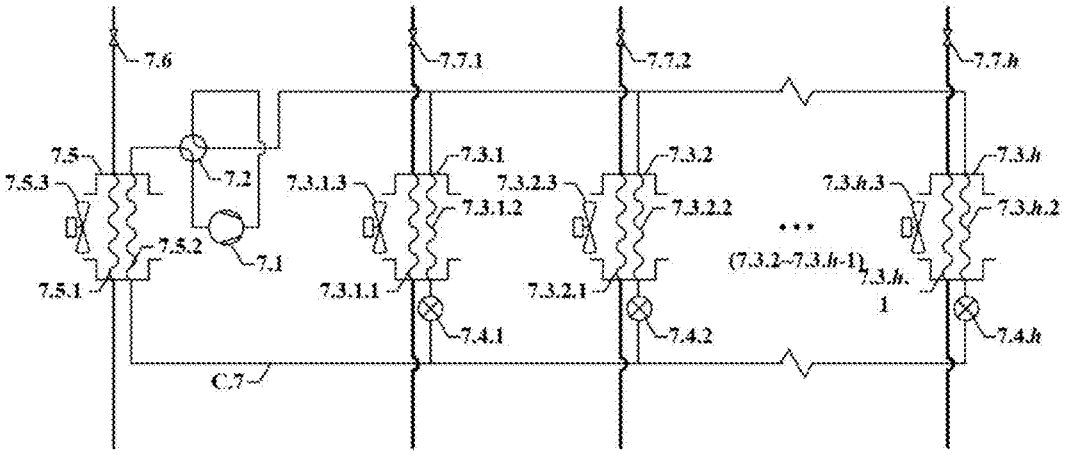
Figure 17:
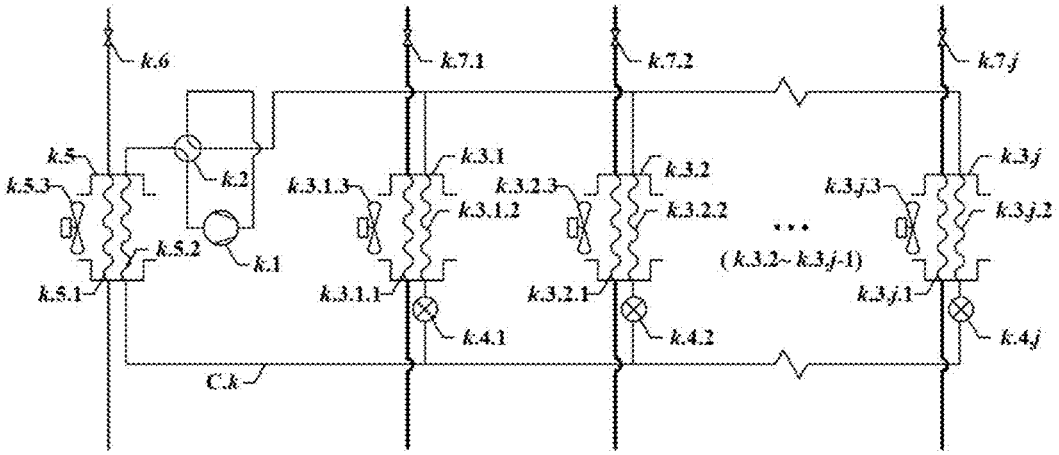

As shown in FIG. 16, when the refrigerating media used in the first circulation loop 200 and the third circulation loop 400 are the same medium, the main heat exchanger 3 can serves as a passage to merge the first circulation loop 200 and the third circulation loop 400 into a single circulation loop. This embodiment can also provide the operation modes in FIGS. 2 to 15. The principles and operation methods of the above-mentioned operation modes implemented by this embodiment are similar to the embodiments described above, and the present application will not repeat here. When the first circulation loop 200 uses the same refrigerating medium as other circulation loops, this approach can not only save pipeline materials, but also reduce the energy grade loss caused by different media heat exchange in the main heat exchanger 3, further enhance the efficiency of the multi-connected air conditioner with refrigerant and water (MACRAW) system during energy scheduling.

From the aforementioned operation modes, the multi-mode multi-connected air conditioner with refrigerant and water (MACRAW) system according to the present application, compared with the prior art, has the following characteristics and technical effects.

(1) The system, on the basis of connecting all outdoor heat exchangers in parallel in one loop, connects all indoor heat exchangers in parallel in two other independent loops simultaneously. The inlet and outlet of all indoor heat exchangers are switchable and connected freely on the two loops, thus different operating parameters are provided for the two loops. The indoor heat exchangers can be divided into different independent loops according to the functions of different rooms.

(2) The loop where the outdoor heat exchanger is located and the loop where the indoor heat exchangers are located are respectively provided with two sets of independent loops, and thermal operating conditions of both are connected through the heat exchanger.

(3) Both loops can be connected to natural energy or other energy recovery equipment, and natural energy or recovered energy is more flexibly used to further improve system energy efficiency.

(4) The system can provide two different operating parameters, freely schedule of the cooling and heating load of each system, avoid energy grade losses due to mixing, and can use different types of refrigerating media, and take into account the advantages of antifreeze and heat exchange.

(5) (5) The system according to the present application can have multiple operation modes. Through various operation modes, in addition to having all functions of a multi-mode water loop multi-connected air-conditioning system disclosed in Chinese Utility Model Patent with application number 20/1920627088.8, it can also facilitate matching different parameters of natural energy and different terminal energy needs, further improve the system efficiency under partial load or even minimal load, avoid simultaneous cooling, simultaneous heating and other conditions, and energy mixing caused by different system requirements, not limited by the operating parameters of the refrigerant loop and water loop, can realize the indoor heat exchanger freely switching cooling or heating mode.

(6) It can balance the need for quick response of intermittent heating and thermal comfort.

(7) The system can efficiently utilize natural energy, recover energy, freely schedule cooling and heating load between systems, defrost by freely scheduling heat, and can improve operating efficiency under low load rate, which ensures that the air conditioning system can operate stably and efficiently throughout the year.

Finally, it should be noted that the foregoing embodiments are merely intended for describing the technical solutions of the present application other than limiting the present application. Although the present application is described in detail with reference to the foregoing embodiments, a person skilled in the art should understand that they may still make modifications to the technical solutions described in the foregoing embodiments or make equivalent replacements to some technical features thereof, without departing from the scope of the technical solutions of embodiments in the present application.

What is claimed is:

1. A multi-mode Multi-connected Air Conditioner with Refrigerant and Water (MACRAW) system, comprising:

multiple air conditioning units, each of the multiple air conditioning units comprising a refrigerant circulation loop, at least one outdoor heat exchanger and at least one indoor heat exchanger, refrigerant circulation loops within the multiple air conditioning units being independent of each other;

a first medium channel being provided inside the at least one outdoor heat exchanger and the at least one indoor heat exchanger, respectively;

at least one the outdoor heat exchanger and the at least one indoor heat exchanger in each of the multiple air conditioning units communicating with the refrigerant circulation loops independent of each other through the first medium channel and the communication, closure, and flow regulation of the first medium channel in each of the at least one indoor heat exchanger being controlled by disposing an expansion valve;

the refrigerant circulation loop being provided with a compressor for driving the refrigerant to flow and a four-way valve for switching a flow direction of the refrigerant, wherein the MACRAW system further comprises:

a first circulation loop, a second circulation loop, and a main heat exchanger, the first circulation loop is provided with a first circulation pump and a natural energy collector, the second circulation loop is provided with a second circulation pump, the first circulation loop and the second circulation loop exchange heat with each other through the main heat exchanger, a second medium channel is provided inside the at least one outdoor heat exchanger and the at least one indoor heat exchanger, the at least one outdoor heat exchanger of each of the multiple air conditioning units is connected in parallel and communicates with the first circulation loop through the second medium channel, and the first circulation loop exchanges heat with the first medium channel in the at least one outdoor heat exchanger through the second medium channel, a first air heat exchange channel is provided inside the at least one outdoor heat exchanger and the first air heat exchange channel exchanges heat with the first medium channel and/or the second medium channel in the at least one outdoor heat exchanger, and the heat in the first air heat exchange channel is transferred to the outside with an airflow by disposing a first fan, the at least one indoor heat exchanger of each of the multiple air conditioning unit is connected in parallel and communicates with the second circulation loop through the second medium channel, and the second circulation loop exchanges heat with the first medium channel in each of the at least one indoor heat exchanger through the second medium channel, the communication and closure between the second medium channel in each of the at least one outdoor heat exchanger and the first circulation loop are controlled by disposing a first valve and the communication and closure between the second medium channel in each of the at least one indoor heat exchanger and the second circulation loop are controlled by disposing a second valve, a second air heat exchange channel is provided inside the at least one indoor heat exchanger, and exchanges heat with the first medium channel and/or the second medium channel within the at least one indoor heat exchanger and heat in the second air heat exchange channel is transferred to an indoor environment with the airflow by disposing a second fan.

2. The multi-mode MACRAW system of claim 1, further comprising:

a third circulation loop provided with a third circulation pump;

wherein the at least one indoor heat exchanger of each of the multiple air conditioning units is connected in parallel and communicates with the third circulation loop through the second medium channel, and the third circulation loop exchanges heat with the first medium channel and/or the second air heat exchange channel in each of the at least one indoor heat exchanger through each second medium channel, the third circulation loop is separated from the second circulation loop by disposing a third valve, and the communication and closure between the third circulation loop and the second medium channel are controlled by the third valve.

3. The multi-mode MACRAW system of claim 2, further comprising at least one heat exchange device, wherein the at least one heat exchange device is separately connected in parallel and communicates with the second circulation loop and/or the third circulation loop, and the communication and closure between the at least one heat exchange device and the second circulation loop as well as between the at least one heat exchange device and the third circulation loop are controlled by disposing a fourth valve and a fifth valve, respectively.

4. The multi-mode MACRAW system of claim 1, wherein the first circulation loop is provided with a first bypass, the first bypass is connected in parallel communicates with both ends of the natural energy collector, and the communication and closure between the first bypass and the natural energy collector are controlled by disposing a sixth valve and a seventh valve, respectively.

5. The multi-mode MACRAW system of claim 1, wherein a second bypass is connected in parallel and communicates with the first circulation loop, loop, and a third bypass is connected in parallel and communicates with the second circulation loop;

the second bypass and the third bypass are respectively connected in parallel and communicate with both ends of the main heat exchanger, and the communication and closure between the second bypass and the main heat exchanger are controlled by disposing an eighth valve and a ninth valve, respectively, and the communication and closure between the third bypass and the main heat exchanger are controlled by disposing a tenth valve and an eleventh valve, respectively.

6. The multi-mode MACRAW system of claim 1, wherein the second circulation loop communicates with the natural energy collector through a fourth bypass, and the natural energy collector communicates between the second circulation pump and the main heat exchanger through the fourth bypass.

7. The multi-mode MACRAW system of claim 1, wherein each of the multiple air conditioning units is a multi-connected air conditioning unit with heat recovery function and each of the multiple air conditioning units recovers the heat and transfers the cold and heat between the at least one indoor heat exchanger through refrigerant pipelines inside each of the multiple air conditioning units.

8. The multi-mode MACRAW system of claim 1, wherein the natural energy collector is at least one of the following: a geothermal energy collector, an underground hot water heat collector, a solar heat collector, a cooling tower, a building waste heat collector, or an industrial residual heat collector.

9. The multi-mode MACRAW system of claim 2, wherein a circulating medium within the first circulation loop, the second circulation loop, and the third circulation loop is water or antifreeze.

10. The multi-mode MACRAW system of claim 9, wherein when a refrigerating medium used in the first circulation loop is the same as a refrigerating medium used in the second circulation loop (or the third circulation loop, the main heat exchanger serves as a passage communicating the first circulation loop with either the second circulation loop or the third circulation loop and one of the second circulation loop and the third circulation loop is merged with the first circulation loop to form a fourth circulation loop, and another of the second circulation loop and the third circulation loop is merged with the first circulation loop to form a fifth circulation loop and the at least one outdoor heat exchanger is connected in parallel with the fourth circulation loop or the fifth circulation loop.

11. The multi-mode MACRAW system of claim 6, wherein the natural energy collector is at least one of the following: a geothermal energy collector, an underground hot water heat collector, a solar heat collector, a cooling tower, a building waste heat collector, or an industrial residual heat collector.

* * * * *